US011149217B2

(12) United States Patent
Marques et al.

(10) Patent No.: US 11,149,217 B2
(45) Date of Patent: Oct. 19, 2021

(54) METHOD FOR CONVERTING HEAVY HYDROCARBON FEEDSTOCKS WITH RECYCLING OF A DEASPHALTED OIL

(71) Applicant: IFP Energies nouvelles, Rueil-Malmaison (FR)

(72) Inventors: Joao Marques, Chasse sur Rhone (FR); Jan Verstraete, Irigny (FR)

(73) Assignee: IFP Energies nouvelles, Rueil-Malmaison (FR)

( * ) Notice: Subject to any disclaimer, the term of this patent is extended or adjusted under 35 U.S.C. 154(b) by 0 days.

(21) Appl. No.: 16/957,078

(22) PCT Filed: Dec. 7, 2018

(86) PCT No.: PCT/EP2018/084052

§ 371 (c)(1),
(2) Date: Jun. 22, 2020

(87) PCT Pub. No.: WO2019/121073

PCT Pub. Date: Jun. 27, 2019

(65) Prior Publication Data

US 2020/0339894 A1 Oct. 29, 2020

(30) Foreign Application Priority Data

Dec. 21, 2017 (FR) ..... 17/62.868

(51) Int. Cl.
*C10G 67/04* (2006.01)
*C10G 21/00* (2006.01)
(Continued)

(52) U.S. Cl.
CPC ..... *C10G 67/0463* (2013.01); *C10G 21/003* (2013.01); *C10G 45/08* (2013.01);
(Continued)

(58) Field of Classification Search
CPC .. C10G 67/0463; C10G 21/003; C10G 45/08; C10G 45/16; C10G 2300/1077;
(Continued)

(56) References Cited

U.S. PATENT DOCUMENTS 10,501,695 B2 12/2019 Morel et al.
2013/0112595 A1 5/2013 Al-Abdulal et al.
2016/0304794 A1* 10/2016 Majcher ..... C10G 53/06

FOREIGN PATENT DOCUMENTS

FR 2907459 A1 4/2008
FR 2999599 A1 6/2014
(Continued)

OTHER PUBLICATIONS

International Search Report PCT/EP2018/084052 dated Feb. 13, 2019 (pp. 1-14).

*Primary Examiner* — Randy Boyer
*Assistant Examiner* — Juan C Valencia
(74) *Attorney, Agent, or Firm* — Millen White Zelano & Branigan; Csaba Henter

(57) ABSTRACT

The invention relates to a process for converting a heavy hydrocarbon feedstock containing a fraction of at least 50% with a boiling point of at least 300° C., and containing sulfur, Conradson carbon, metals, and nitrogen, comprising at least two successive hydroconversion steps, which may be separated by an intermediate separation step, and at least one step of deasphalting a heavy fraction of the effluent resulting from the hydroconversion, with recycling at least one portion of the deasphalted oil (DAO) during the hydroconversion, downstream of the first hydroconversion step. The DAO is either recycled at the outlet thereof from the deasphalter, or after having undergone a fractionation step that produces a heavy fraction of the DAO that then constitutes the portion of the DAO that is recycled. This process
(Continued)

makes it possible to simultaneously improve the degree of conversion and the stability of the liquid effluents.

20 Claims, 3 Drawing Sheets

(51) Int. Cl.
*C10G 45/08* (2006.01)
*C10G 45/16* (2006.01)

(52) U.S. Cl.
CPC ..... *C10G 45/16* (2013.01); *C10G 2300/1077* (2013.01); *C10G 2300/202* (2013.01); *C10G 2300/206* (2013.01); *C10G 2300/301* (2013.01); *C10G 2300/4006* (2013.01); *C10G 2300/4012* (2013.01); *C10G 2300/4018* (2013.01); *C10G 2300/4081* (2013.01); *C10G 2300/44* (2013.01)

(58) Field of Classification Search
CPC ..... C10G 2300/202; C10G 2300/206; C10G 2300/301; C10G 2300/4006; C10G 2300/4012; C10G 2300/4018; C10G 2300/4081; C10G 2300/44; C10G 45/22; C10G 65/04
See application file for complete search history.

(56) References Cited

FOREIGN PATENT DOCUMENTS

| | | | | |
|---|---|---|---|---|
| FR | 3030568 | A1 | 6/2016 | |
| WO | 10033487 | A2 | 3/2010 | |
| WO | WO-2010033487 | A2 * | 3/2010 | ..... C10G 65/00 |

* cited by examiner

METHOD FOR CONVERTING HEAVY HYDROCARBON FEEDSTOCKS WITH RECYCLING OF A DEASPHALTED OIL

FIELD OF THE INVENTION

The present invention relates to the refining and the conversion of heavy hydrocarbon feedstocks resulting either from a crude oil, or from the distillation of crude oil, said feedstocks comprising a fraction of at least 50% with a boiling point of at least 300° C., and containing inter alia asphaltenes, sulfur-containing impurities, nitrogen-containing impurities and metals. It is desired to convert these feedstocks into lighter products, that can be upgraded as fuels, for example to produce petroleums or diesel fuels, or raw materials for the petrochemical industry.

In particular, the invention relates to a process for converting such a heavy feedstock including steps of hydroconversion in a three-phase reactor with an ebullated-bed operation and deasphalting of a fraction of the product resulting from the hydroconversion, in which the deasphalted oil, referred to as DAO, resulting from the deasphalting is recycled during the hydroconversion.

General Context

The feedstocks that it is desired to treat within the context of the present invention are either crude oils, or heavy hydrocarbon fractions resulting from the distillation of crude oil, also referred to as petroleum residues, and contain a fraction of at least 50% with a boiling point of at least 300° C., preferably of at least 350° C. and preferably of at least 375° C. These are preferably vacuum residues containing a fraction of at least 50% with a boiling point of at least 450° C., and preferably of at least 500° C.

These feedstocks generally have a sulfur content of at least 0.1%, sometimes of at least 1% and even of at least 2% by weight, a Conradson carbon content of at least 0.5% by weight and preferably of at least 5% by weight, a 07 asphaltenes content of at least 1% by weight and preferably of at least 3% by weight and a metals content of at least 20 ppm by weight and preferably of at least 100 ppm by weight.

The upgrading of these heavy feedstocks is relatively difficult, both from a technical point of view and from an economical point of view.

Specifically, the market above all demands fuels that can be distilled at atmospheric pressure at a temperature below 380° C., or even below 320° C. Regarding crude oils, the atmospheric distillation thereof leads to variable contents of atmospheric residues that depend on the origin of the crude oils treated. This content generally varies between 20% and 50% for conventional crude oils, but may reach 50% to 80% for heavy and extra-heavy crude oils such as for example those produced in Venezuela or in the Athabasca region in northern Canada. It is therefore necessary to convert these residues, by transforming the heavy molecules of residues in order to produce refined products consisting of lighter molecules. These refined products generally have a much larger hydrogen-to-carbon ratio than the initial heavy cuts. A series of processes used for producing refined light cuts, such as hydrocracking, hydrotreating and hydroconversion processes, is therefore based on the addition of hydrogen to the molecules, preferably at the same time as the cracking of these heavy molecules.

The conversion of the heavy feedstocks depends on a large number of parameters such as the composition of the feedstock, the technology of the reactor used, the severity of the operating conditions (temperature, pressure, partial pressure of hydrogen, residence time, etc.), the type of catalyst used and its activity. By increasing the severity of the operation, the conversion of the heavy feedstocks into light products is increased, but byproducts, such as coke precursors and sediments, begin to be formed significantly via secondary reactions. The advanced conversion of the heavy feedstocks therefore very often results in the formation of solid, highly viscous and/or tacky particles composed of asphaltenes, coke and/or fine catalyst particles. The excessive presence of these products results in coking and deactivation of the catalyst, to fouling of the process equipment and in particular of the separation and distillation equipment. Therefore, the refiner is obliged to reduce the conversion of the heavy feedstocks in order to prevent the shutdown of the hydroconversion unit.

The formation of these sediments in hydrotreating and hydroconversion processes therefore depends very greatly on the quality of the feedstock and on the severity of the operation. More specifically, the asphaltenes present in the feedstock are mainly converted by dealkylation under severe hydroconversion conditions and therefore form molecules including highly fused aromatic rings that precipitate in the form of sediments.

The processes for hydroconversion of heavy hydrocarbon feedstocks are well known to a person skilled in the art. In particular, the conventional schemes for converting heavy feedstocks include a solvent deasphalting (SDA) step and a hydroconversion step performed in a fixed bed, in a moving bed, in an ebullated bed and/or in a hybrid bed.

Since the hydroconversion steps are performed in a fixed bed, in a moving bed, in an ebullated bed and/or in a hybrid bed depending on the feedstock to be treated, these steps therefore always contain at least one catalyst that is maintained in the reactor during the operation. In the present application, the term hybrid bed refers to a mixed bed of catalysts of different particle size, simultaneously including at least one catalyst that is kept in the reactor and at least one entrained catalyst (slurry) that enters the reactor with the feedstock and which is entrained out of the reactor with the effluents. The deasphalting and the hydroconversion are conventionally performed successively. In particular, two types of processes for converting heavy feedstocks that combine deasphalting and hydroconversion are distinguished:

- a first type of process, known under the name "indirect route", uses the deasphalting unit placed upstream of the hydroconversion unit. According to this route, the feedstock is treated at least partly in a deasphalting unit before being sent at least partly to a hydroconversion unit including one or more hydroconversion reactors in the presence of hydrogen. U.S. Pat. No. 7,214,308 thus describes a process for converting the atmospheric or vacuum residue resulting from the distillation of heavy crude oils, in which the residue is firstly sent to a solvent deasphalting unit that produces a DAO stream and an asphalt stream, the two streams then being treated separately in reactors with ebullated-bed operation. The process then allows a higher level of conversion of the residue because the separate hydroconversion of the DAO stream uses a catalyst specific for the DAO treatment and is possibly performed so as to achieve a more thorough conversion. A main drawback of the indirect route lies in the large size required for the deasphalter leading to high investment and operating costs.
- a second type of process, known under the name "direct route", uses a deasphalting unit placed downstream of the hydroconversion unit. In general, in this type of process, an atmospheric distillation step, and optionally a vacuum distillation step following the atmospheric distillation step, is performed between the two individual steps constituted by the hydroconversion and the deasphalting. This is the case, for example, for the process described in patent FR 2 753 984, in which a heavy feedstock is first conveyed to a hydroconversion section comprising at least one three-phase reactor containing a hydroconversion catalyst in an ebullated bed and hydrogen and functioning with an upflow of liquid and of gas. The conditions applied in the hydroconversion reaction section make it possible to obtain a liquid effluent with a reduced content of Conradson carbon, metals, nitrogen and sulfur. This effluent is then separated into several fractions, including one or more residual fractions: the hydroconverted liquid effluent is sent to an atmospheric distillation zone producing a distillate and an atmospheric residue, and at least a portion of the atmospheric residue is sent to a vacuum distillation zone, after which a vacuum distillate and a vacuum residue are recovered. The vacuum residue is then at least partly sent to a deasphalting section in which is used a liquid-liquid extractor with the aid of a solvent under deasphalting conditions known to those skilled in the art, making it possible to obtain a DAO and a residual asphalt. The DAO thus obtained is then subjected to a hydrotreatment, either in a fixed bed, in a moving bed, in an ebullated bed and/or in a hybrid bed, under conditions making it possible in particular to reduce its content of metals, sulfur, nitrogen and Conradson carbon and to obtain, after a new separation by distillation, a gaseous fraction, an atmospheric distillate which can be split into a gasoline and gas oil fraction then sent to the fuel pool and a heavier hydrotreated fraction. This heavier fraction may then be sent to a catalytic cracking or catalytic hydrocracking section, for example.

US 2010/320122A, U.S. Pat. Nos. 6,017,441, 3,905,892, 4,176,048, US 2012/061293A and U.S. Pat. No. 8,287,720 describe various possible configurations for the direct route, in which a first hydroconversion step is performed followed by the step of deasphalting the heavy cut resulting from an intermediate separation of the hydroconverted effluent, then a second step of hydroconversion, hydrotreating or hydrocracking of the DAO is performed. In these configurations, the formation of coke and of sediments may still occur during the second hydroconversion step in the case where the DAO is cotreated with a feedstock containing asphaltenes. Furthermore, a large amount of asphalt is produced during the deasphalting step after the first hydroconversion step with low conversion of asphaltenes, as in the case of the scheme proposed in patent U.S. Pat. No. 4,176,048. This asphalt is a low-value product which is furthermore difficult to convert into fuels.

Another configuration according to the direct route consists in performing the step of deasphalting heavy cuts after a hydroconversion step thus make it possible to minimize the amount of asphalt produced, then to recycle the DAO into the inlet of the first hydroconversion zone or into fractionation zones upstream of the first hydroconversion zone, as described in patent applications FR 2 964 388 and FR 2 999 599. This configuration requires a significant increase in the volume of the reaction zones and also of the separation zones, increasing the required investment and the operating cost relative to a conversion process without recycling of DAO. Moreover, in this configuration, problems of formation of coke and sediments may still be encountered during the hydroconversion step where the DAO is recycled and cotreated with the heavy feedstock containing asphaltenes.

OBJECTIVES AND SUMMARY OF THE INVENTION

The present invention aims to at least partially solve the problems mentioned above in connection with the processes for converting heavy feedstocks from the prior art that integrate hydroconversion and deasphalting steps.

In particular, one of the objectives of the invention is to provide a process for converting heavy hydrocarbon feedstocks that integrates hydroconversion and deasphalting steps in which the stability of the effluents is improved for a given degree of conversion of the heavy feedstocks, thus making it possible to further advance the conversion in the process, i.e. to operate the hydroconversion so as to obtain a higher degree of conversion.

Another objective of the invention is to provide such a process in which the formation of coke and of sediments is limited during the hydroconversion, thus reducing the problems of deactivation of the catalysts used in the reaction zones and of fouling of the equipment used in the process.

Another objective of the invention is also to provide a good-quality DAO, i.e. one having a reduced content of nitrogen, sulfur, metals and Conradson carbon.

Thus, in order to achieve at least one of the aforementioned objectives, amongst others, the present invention proposes a process for converting a heavy hydrocarbon feedstock containing a fraction of at least 50% with a boiling point of at least 300° C., and containing sulfur, Conradson carbon, metals, and nitrogen, comprising the following successive steps:

an initial step of hydroconversion ($a_1$) of at least one portion of said heavy hydrocarbon feedstock in the presence of hydrogen in an initial hydroconversion section, performed under conditions that make it possible to obtain a liquid effluent having a reduced content of sulfur, of Conradson carbon, of metals, and of nitrogen;

(n−1) additional hydroconversion step(s) ($a_i$) in (n−1) additional hydroconversion section(s), in the presence of hydrogen, of at least a portion or all of the liquid effluent resulting from the preceding hydroconversion step ($a_{i-1}$) or optionally of a heavy fraction resulting from an optional intermediate separation step ($b_j$) in an intermediate separation section between two consecutive hydroconversion steps separating a portion or all of the liquid effluent resulting from the preceding hydroconversion step ($a_{i-1}$) in order to produce at least one heavy fraction that boils predominantly at a temperature greater than or equal to 350° C., the (n−1) additional hydroconversion step(s) ($a_i$) being performed so as to obtain a hydroconverted liquid effluent having a reduced content of sulfur, of Conradson carbon, of metals, and of nitrogen, n being the total number of hydroconversion steps, with n greater than or equal to 2, i being an integer ranging from 2 to n and j being an integer ranging from 1 to (n−1), and the initial and additional hydroconversion section(s) each including at least one three-phase reactor containing at least one hydroconversion catalyst;

a first step of fractionating (c) in a first fractionation section a portion or all of the hydroconverted liquid effluent resulting from the last additional hydroconversion step ($a_n$) producing at least one heavy cut that boils predominantly at a temperature greater than or equal to 350° C., said heavy cut containing a residual fraction that boils at a temperature greater than or equal to 540° C.;

a step of deasphalting (d) in a deasphalter a portion or all of said heavy cut resulting from the fractionation step (c), with at least one hydrocarbon solvent, in order to obtain a deasphalted oil DAO and a residual asphalt;

optionally a second step of fractionating (e) in a second fractionation section a portion or all of the DAO resulting from the deasphalting step (d) into at least one heavy DAO fraction and one light DAO fraction;

a step of recycling (f) at least one portion of the DAO resulting from step (d) and/or at least one portion of the heavy fraction of the DAO resulting from step (e) into an additional hydroconversion step ($a_i$) and/or into an intermediate separation step ($b_j$).

The heavy hydrocarbon feedstock preferably has a sulfur content of at least 0.1% by weight, a Conradson carbon content of at least 0.5% by weight, a $C_7$ asphaltenes content of at least 1% by weight, and a metals content of at least 20 ppm by weight.

The heavy hydrocarbon feedstock may be a crude oil or consist of atmospheric residues and/or vacuum residues resulting from the atmospheric and/or vacuum distillation of crude oil, and preferably consists of vacuum residues resulting from the vacuum distillation of crude oil.

According to one embodiment of the invention, said three-phase reactor containing at least one hydroconversion catalyst is a three-phase reactor with ebullated-bed operation, with an upflow of liquid and of gas.

According to one embodiment of the invention, the three-phase reactor containing at least one hydroconversion catalyst is a three-phase reactor with hybrid-bed operation, said hybrid bed including at least one catalyst maintained in said three-phase reactor and at least one catalyst entrained out of said three-phase reactor.

According to one embodiment of the invention, the initial hydroconversion step ($a_1$) is performed under an absolute pressure of between 2 and 38 MPa, at a temperature of between 300° C. and 550° C., at an hourly space velocity HSV relative to the volume of each three-phase reactor of between 0.05 $h^{-1}$ and 10 $h^{-1}$ and under an amount of hydrogen mixed with the heavy hydrocarbon feedstock of between 50 and 5000 normal cubic meters ($Nm^3$) per cubic meter ($m^3$) of heavy hydrocarbon feedstock.

According to one embodiment of the invention, the additional hydroconversion step(s) ($a_n$) are performed at a temperature of between 300° C. and 550° C., and above the temperature used in the initial hydroconversion step ($a_1$), under an amount of hydrogen mixed with the heavy hydrocarbon feedstock of between 50 and 5000 normal cubic meters ($Nm^3$) per cubic meter ($m^3$) of heavy hydrocarbon feedstock, and less than the amount of hydrogen used in the initial hydroconversion step ($a_1$), under an absolute pressure of between 2 and 38 MPa, and at an hourly space velocity HSV relative to the volume of each three-phase reactor of between 0.05 $h^{-1}$ and 10 $h^{-1}$.

According to one embodiment of the invention, the intermediate separation section comprises one or more flash drums arranged in series, and/or one or more steam- and/or hydrogen-stripping columns, and/or an atmospheric distillation column, and/or a vacuum distillation column, and is preferably constituted by a single flash drum.

According to one embodiment of the invention, the first fractionation section comprises one or more flash drums arranged in series, and/or one or more steam- and/or hydrogen-stripping columns, and/or an atmospheric distillation column, and/or a vacuum distillation column, and is preferably constituted by a set of several flash drums in series and atmospheric and vacuum distillation columns.

According to one embodiment of the invention, the deasphalting step (d) is performed in an extraction column at a temperature of between 60° C. and 250° C. with at least one hydrocarbon solvent containing from 3 to 7 carbon atoms, and a (volume/volume) solvent/feedstock ratio of between 3/1 and 16/1, and preferably of between 4/1 and 8/1.

According to one embodiment of the invention, a portion of the heavy hydrocarbon feedstock is sent to at least one additional hydroconversion section and/or to at least one intermediate separation section and/or to the first fractionation section and/or to the deasphalter.

According to one embodiment of the invention, a hydrocarbon feedstock external to the process is sent to the initial hydroconversion section and/or to at least one additional hydroconversion section and/or to at least one intermediate separation section and/or to the first fractionation section and/or to the deasphalter.

According to one embodiment of the invention, the process further comprises at least one recycling step below:

the recycling ($r_1$) of a portion or all of the light fraction of the DAO resulting from step (e) into the initial hydroconversion section and/or into at least one additional hydroconversion section and/or into at least one intermediate separation section and/or into the first fractionation section;

the recycling ($r_2$) of a portion of the heavy fraction of the DAO resulting from step (f) into the first fractionation section;

the recycling ($r_3$) of a portion of the DAO resulting from step (d) into the first fractionation section;

the recycling ($r_4$) of a portion or all of the residual asphalt resulting from step (d) into the initial hydroconversion section and/or into at least one additional hydroconversion section;

the recycling ($r_5$) of a portion of the hydroconverted liquid effluent from a given additional hydroconversion section:

into the initial hydroconversion section, and/or into another additional hydroconversion section positioned upstream of said given section, and/or into an intermediate separation section positioned upstream of said given section;

the recycling ($r_6$) of a portion of the heavy fraction and/or of a portion or all of one or more intermediate fractions resulting from a given intermediate section:

into the initial hydroconversion section, and/or into an additional hydroconversion section positioned upstream of said given intermediate section, and/or into another intermediate separation section positioned upstream of said given section;

the recycling ($r_7$) of a portion of the heavy fraction and/or of a portion or all of one or more intermediate fractions resulting from the first fractionation section:

into the initial hydroconversion section, and/or into an additional hydroconversion section, and/or into an intermediate separation section.

According to one embodiment of the invention, n is equal to 2.

According to one embodiment of the invention, the process includes the recycling (f) of all of the DAO resulting from step (d) or of all of the heavy fraction resulting from the second fractionation step (e) into the last additional hydroconversion step ($a_i$), and preferably into the additional hydroconversion step ($a_2$) when n is equal to 2 and moreover when all of the liquid effluent resulting from step ($a_1$) is sent to step ($b_1$), all of the heavy fraction resulting from step ($b_1$) is sent to step ($a_2$), all of the hydroconverted liquid effluent resulting from step ($a_2$) is sent to step (c), and all of the heavy cut resulting from step (c) is sent to step (d).

According to one embodiment of the invention, the process includes the recycling (f) of all of the DAO resulting from step (d) or of all of the heavy fraction resulting from the second fractionation step (e) into an intermediate separation step ($b_j$), and preferably into the intermediate separation step ($b_1$) between the initial hydroconversion step ($a_1$) and the additional hydroconversion step ($a_2$) when n is equal to 2 and moreover when all of the liquid effluent resulting from step ($a_1$) is sent to step ($b_1$), all of the heavy fraction resulting from step ($b_1$) is sent to step ($a_2$), all of the hydroconverted liquid effluent resulting from step ($a_2$) is sent to step (c), and all of the heavy cut resulting from step (c) is sent to step (d).

According to one embodiment of the invention, the process does not include an intermediate separation step ($b_j$) and includes the recycling (f) of all of the DAO resulting from step (d) into the last additional hydroconversion step ($a_i$), and preferably into the additional hydroconversion step ($a_2$) when n is equal to 2 and moreover when all of the liquid effluent resulting from step ($a_1$) is sent to step ($a_2$), all of the hydroconverted liquid effluent resulting from step ($a_2$) is sent to step (c), and all of the heavy cut resulting from step (c) is sent to step (d).

According to one embodiment of the invention, the hydroconversion catalyst of said at least one three-phase reactor of the initial hydroconversion section and of the additional hydroconversion section(s) contains at least one metal from the non-noble group VIII chosen from nickel and cobalt and at least one metal from group VIB chosen from molybdenum and tungsten, and preferably including an amorphous support.

Other objectives and advantages of the invention will become apparent on reading the detailed description which follows of the process, and also specific exemplary embodiments of the invention, given by way of nonlimiting examples, the description being made with reference to the appended figures described below.

In the figures, the same references denote identical or analogous elements.

DESCRIPTION OF THE INVENTION

The process for converting heavy hydrocarbon feedstocks according to the invention integrates a hydroconversion of said feedstocks and a deasphalting of at least one portion of the hydroconverted effluent in the form of a succession of specific steps.

Figure 1:
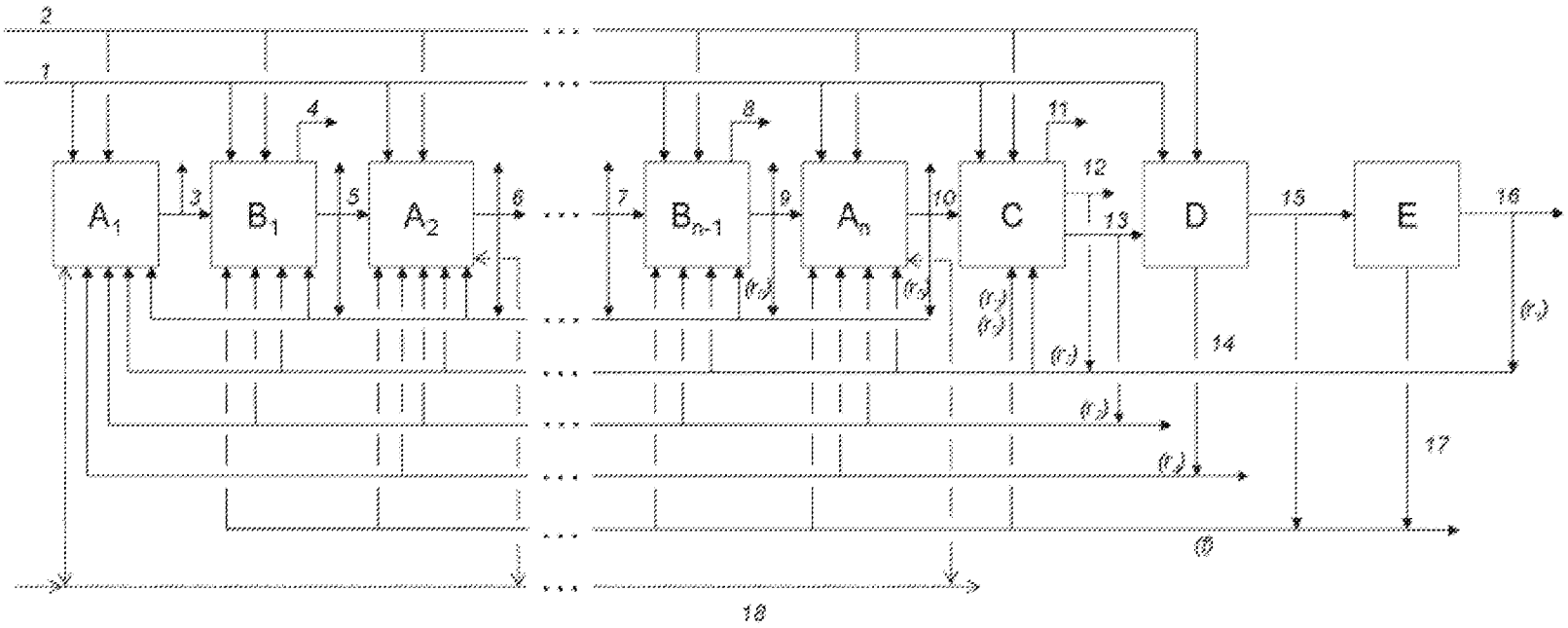
FIG. 1 is a schematic diagram of the implementation of the conversion process according to the invention.

In the remainder of the description, reference is made to FIG. 1 which illustrates the general implementation of the conversion process according to the invention.

In the present invention, it is proposed to simultaneously improve the degree of conversion and the stability of the liquid effluents by a sequence including at least two successive hydroconversion steps, which may be separated by an intermediate separation step, and at least one step of deasphalting a heavy fraction of the effluent resulting from the hydroconversion, with recycling of at least one portion of the DAO downstream of the first hydroconversion step. The DAO is either recycled at the outlet thereof from the deasphalter, or after having undergone a fractionation step that produces a heavy fraction of the DAO that then constitutes the portion of the DAO that is recycled. This configuration makes it possible to achieve a conversion of the heavy hydrocarbon feedstock of greater than 70% and preferably greater than 80%, this degree of conversion not always being able to be achieved using conventional processes which are limited by the stability of the liquid effluents.

The net conversion is defined as being the ratio of the (flow rate of residue in the feedstock−the flow rate of residue in the product)/(flow rate of residue in the feedstock) for the same feedstock-product cut point; typically this cut point is between 450° C. and 550° C., and often around 540° C.; in this definition, the residue being the fraction that boils starting from this cut point, for example, the 540° C.+ fraction.

Thus, a process is proposed for converting a heavy hydrocarbon feedstock, for example a crude oil or the heavy hydrocarbon fraction resulting from the atmospheric or vacuum distillation of a crude oil, said feedstock containing a fraction of at least 50% with a boiling point of at least 300° C., comprising the following successive steps:

- an initial step of hydroconversion ($a_1$) of at least one portion of said heavy hydrocarbon feedstock in the presence of hydrogen in an initial hydroconversion section $A_1$, performed under conditions that make it possible to obtain a liquid effluent having a reduced content of sulfur, of Conradson carbon, of metals, and of nitrogen;
- (n−1) additional hydroconversion step(s) ($a_i$) in (n−1) additional hydroconversion section(s) $A_i$, in the presence of hydrogen, of at least a portion or all of the liquid effluent resulting from the preceding hydroconversion step ($a_{i-1}$) or optionally of a heavy fraction resulting from an optional intermediate separation step ($b_j$) between two consecutive hydroconversion steps separating a portion or all of the liquid effluent resulting from the preceding hydroconversion step ($a_{i-1}$) in order to produce at least one heavy fraction that boils predominantly at a temperature greater than or equal to 350° C., the (n−1) additional hydroconversion step(s) ($a_i$) being performed so as to obtain a hydroconverted liquid effluent having a reduced content of sulfur, of Conradson carbon, of metals, and of nitrogen;

n being the total number of hydroconversion steps, with n greater than or equal to 2, i being an integer ranging from 2 to n and j being an integer ranging from 1 to (n−1), and the initial $A_1$ and additional $A_i$ hydroconversion section(s) each including at least one three-phase reactor containing at least one hydroconversion catalyst;

a first step of fractionating (c) in a first fractionation section C a portion or all of the hydroconverted liquid effluent resulting from the last additional hydroconversion step ($a_n$) in order to produce at least one heavy cut that boils predominantly at a temperature greater than or equal to 350° C., said heavy cut containing a residual fraction that boils at a temperature greater than or equal to 540° C.;

a step of deasphalting (d) in a deasphalter D a portion or all of said heavy cut resulting from the fractionation step (c), with at least one hydrocarbon solvent, in order to obtain a deasphalted oil DAO and a residual asphalt;

optionally a second step of fractionating (e) in a second fractionation section E a portion or all of the DAO resulting from the deasphalting step (d) into at least one heavy DAO fraction and one light DAO fraction;

a step of recycling (f) at least one portion of the DAO resulting from step (d) and/or at least one portion of the heavy fraction of the DAO resulting from step (e) into an additional hydroconversion step ($a_i$) and/or into an intermediate separation step ($b_j$).

According to one preferred embodiment, the process according to the invention contains two hydroconversion steps, and an optional intermediate separation step between these two hydroconversion steps. According to this embodiment, n is equal to 2, and the process then comprises:

an initial step of hydroconversion ($a_1$) of at least one portion of said heavy hydrocarbon feedstock in the presence of hydrogen in an initial hydroconversion section $A_1$, performed under conditions that make it possible to obtain a liquid effluent having a reduced content of sulfur, of Conradson carbon, of metals, and of nitrogen;

an additional hydroconversion step ($a_2$) in an additional hydroconversion section $A_2$, in the presence of hydrogen, of at least a portion or all of the liquid effluent resulting from the initial hydroconversion step ($a_1$) or optionally of a heavy fraction resulting from an optional intermediate separation step ($b_1$) between the initial ($a_1$) and additional ($a_2$) hydroconversion steps separating a portion or all of the liquid effluent resulting from the initial hydroconversion step ($a_1$) in order to produce at least one heavy fraction that boils predominantly at a temperature greater than or equal to 350° C., the additional hydroconversion step ($a_2$) being performed so as to obtain a hydroconverted liquid effluent having a reduced content of sulfur, of Conradson carbon, of metals, and of nitrogen, the initial ($A_1$) and additional ($A_2$) hydroconversion sections each including at least one three-phase reactor containing at least one hydroconversion catalyst;

a first step of fractionating (c) in a first fractionation section C a portion or all of the hydroconverted liquid effluent resulting from the additional hydroconversion step ($a_2$) in order to produce at least one heavy cut that boils predominantly at a temperature greater than or equal to 350° C., said heavy cut containing a residual fraction that boils at a at a temperature greater than or equal to 540° C.;

a step of deasphalting (d) in a deasphalter D a portion or all of said heavy cut resulting from the fractionation step (c), with at least one hydrocarbon solvent, in order to obtain a deasphalted oil DAO and a residual asphalt;

optionally a second step of fractionating (e) in a second fractionation section E a portion or all of the DAO resulting from the deasphalting step (d) into at least one heavy DAO fraction and one light DAO fraction;

a step of recycling (f) at least one portion of the DAO resulting from step (d) and/or at least one portion of the heavy fraction of the DAO resulting from step (e) into an additional hydroconversion step ($a_2$) and/or into an intermediate separation step ($b_1$).

The DAO obtained by the process according to the invention contains no or very few $C_7$ asphaltenes, compounds known for inhibiting the conversion of residual cuts, both by their ability to form heavy hydrocarbon residues, commonly referred to as coke, and by their tendency to produce sediments that greatly limit the operability of the hydrotreating and hydroconversion units. The DAO obtained by the process according to the invention is also more aromatic than a DAO produced from a heavy petroleum feedstock resulting from the primary (straight-run) fractionation of the crude oil since it is derived from an effluent which has previously undergone a high degree of hydroconversion.

The mixture of at least one portion of the DAO and of the effluent resulting from the first hydroconversion section(s) in the process according to the invention makes it possible to feed the subsequent hydroconversion step(s) with a feedstock having a reduced 07 asphaltenes content and a higher content of aromatic compounds both relative to a process including a hydroconversion unit without recycling of the DAO, and relative to a process comprising a hydroconversion unit with recycling of the DAO upstream of a first hydroconversion or hydrotreating step. Therefore, it is possible to impose more severe operating conditions in the process according to the invention, in particular in the additional hydroconversion steps, and to thus achieve higher levels in terms of conversion of the feedstock, while limiting the production of sediments.

The effluent from the last additional hydroconversion step is separated into several cuts. The deasphalting is then performed on the heavy cut(s) produced in this separation step. The use of these cuts obtained at the highest degree of conversion thus makes it possible to minimize the size required for the deasphalter and minimize the amount of asphalt produced. According to the invention, the DAO extracted by deasphalting is always recycled after the initial hydroconversion step, either into the inlet of one of the intermediate separation sections, or into the inlet of one of the additional hydroconversion sections, preferably into the inlet of the section of the last additional hydroconversion step. According to these two embodiments, the size of the reactors of the first hydroconversion sections is not impacted, and according to the second embodiment, neither the size of the intermediate separation equipment nor the size of the reactors of the prior hydroconversion steps are impacted. The injection of the DAO downstream of the initial hydroconversion section makes it possible to avoid the prior hydrogenation of the DAO thus preserving its aromatic nature (characterized by the content of aromatic carbon measured by the ASTM D 5292 method) which provides a gain with respect to the stability of the liquid effluents from the zones where the highest degrees of conversion are achieved. An operation for achieving higher degrees of conversion can therefore be envisaged in the process according to the invention.

Feedstock

The feedstock treated in the process according to the invention is a heavy hydrocarbon feedstock containing a fraction of at least 50% with a boiling point of at least 300° C., preferably of at least 350° C., and even more preferably of at least 375° C.

This heavy hydrocarbon feedstock may be a crude oil, or originate from the refining of a crude oil or from the processing of another hydrocarbon source in a refinery.

Preferably, the feedstock is a crude oil or is formed of atmospheric residues and/or of vacuum residues resulting from the atmospheric and/or vacuum distillation of a crude oil.

The heavy hydrocarbon feedstock may also be formed of atmospheric and/or vacuum residues resulting from the atmospheric and/or vacuum distillation of effluents originating from thermal conversion, hydrotreating, hydrocracking and/or hydroconversion units.

Preferably, the feedstock is formed of vacuum residues. These vacuum residues generally contain a fraction of at least 50% with a boiling point of at least of at least 450° C., and usually of at least 500° C., or even of at least 540° C. The vacuum residues may come directly from the crude oil, or from other refining units, such as, inter alia, the hydrotreating of residues, the hydrocracking of residues, and the visbreaking of residues. Preferably, the vacuum residues are vacuum residues resulting from the vacuum distillation column of the primary (straight-run) fractionation of the crude oil.

The feedstock may also be formed of vacuum distillates, originating either directly from the crude oil or from cuts originating from other refining units, such as, inter alia, cracking units, such as fluid catalytic cracking (FCC) and hydrocracking, and from thermal conversion units, such as coker units or visbreaking units.

It may also be formed of aromatic cuts extracted from a unit for the production of lubricants, deasphalted oils resulting from a deasphalting unit (raffinates of the deasphalting unit) or asphalts resulting from a deasphalting unit (residues of the deasphalting unit).

The heavy hydrocarbon feedstock may also be a residual fraction resulting from direct coal liquefaction (an atmospheric residue and/or a vacuum residue resulting, for example, from the H-Coal™ process), a vacuum distillate resulting from direct coal liquefaction, for instance the H-Coal™ process, or else a residual fraction resulting from the direct liquefaction of lignocellulose biomass, alone or as a mixture with coal and/or a petroleum fraction.

All these feedstocks may be used to form the heavy hydrocarbon feedstock treated according to the invention, alone or as a mixture.

The heavy hydrocarbon feedstock treated according to the invention contains impurities, such as metals, sulfur, nitrogen, Conradson carbon. It may also contain heptane insolubles, also referred to as $C_7$ asphaltenes. The contents of metals may be greater than or equal to 20 ppm by weight, preferably greater than or equal to 100 ppm by weight. The sulfur content may be greater than or equal to 0.1%, indeed even greater than or equal to 1%, and may be greater than or equal to 2% by weight. The content of $C_7$ asphaltenes (heptane-insoluble compounds according to the standard NFT60-115 or the standard ASTM D 6560) amounts to at least 1% and is often greater than or equal to 3% by weight. $C_7$ asphaltenes are compounds known for inhibiting the conversion of residual cuts, both by their ability to form heavy hydrocarbon residues, commonly referred to as coke, and by their tendency to produce sediments which greatly limit the operability of the hydrotreating and hydroconversion units. The Conradson carbon content may be greater than or equal to 0.5%, or even at least 5%, by weight. The Conradson carbon content is defined by the standard ASTM D 482 and represents, for a person skilled in the art, a well-known evaluation of the amount of carbon residues produced after a pyrolysis under standard temperature and pressure conditions.

Initial Hydroconversion Step ($a_1$)

In accordance with the invention, the heavy hydrocarbon feedstock is treated in the presence of hydrogen in a first hydroconversion step ($a_1$), within an initial hydroconversion section $A_1$. The initial hydroconversion section comprises one or more three-phase reactors containing at least one hydroconversion catalyst, it being possible for the reactors to be arranged in series and/or in parallel. These reactors may be, inter alia, reactors of fixed-bed, moving-bed, ebullated-bed and/or hybrid-bed type, depending on the feedstock to be treated.

The invention is particularly well suited to three-phase reactors with ebullated-bed operation, with an upflow of liquid and of gas. Thus, this initial height conversion step ($a_1$) is advantageously performed in an initial hydroconversion section $A_1$ including one or more three-phase hydroconversion reactors, which may be in series and/or in parallel, with ebullated-bed operation, typically with the aid of the technology and under the conditions of the H-Oil™ process as described, for example, in patents U.S. Pat. Nos. 4,521,295, 4,495,060, 4,457,831 or U.S. Pat. No. 4,354,852, or in the article AIChE, Mar. 19-23, 1995, Houston, Tex., paper number 46d, "Second generation ebullated bed technology", or in chapter 3.5 "Hydroprocessing and Hydroconversion of Residue Fractions" from the book "Catalysis by Transition Metal Sulphides", published by Éditions Technip in 2013. According to this embodiment, each three-phase reactor is operated as a fluidized bed, known as an ebullated bed. Each reactor advantageously includes a recirculation pump which makes it possible to maintain the catalyst in an ebullated bed by continuous recycling of at least a portion of a liquid fraction advantageously withdrawn at the top of the reactor and reinjected at the bottom of the reactor.

The first hydroconversion step ($a_1$) is performed under conditions that make it possible to obtain a liquid effluent having a reduced content of sulfur, Conradson carbon, metals and nitrogen.

In this step ($a_1$), the feedstock is preferably transformed under specific hydroconversion conditions. Step ($a_1$) is preferably performed under an absolute pressure of between 2 MPa and 38 MPa, more preferentially between 5 MPa and 25 MPa and even more preferably between 6 MPa and 20 MPa, at a temperature of between 300° C. and 550° C., more preferentially of between 350° C. and 500° C. and preferably of between 370° C. and 450° C. The hourly space velocity (HSV) relative to the volume of each three-phase reactor is preferably between 0.05 $h^{-1}$ and 10 $h^{-1}$. According to a preferred embodiment, the HSV is between 0.1 $h^{-1}$ and 10 $h^{-1}$, more preferentially between 0.1 $h^{-1}$ and 5 $h^{-1}$ and even more preferably between 0.15 $h^{-1}$ and 2 $h^{-1}$. According to another embodiment, the HSV is between 0.05 $h^{-1}$ and 0.09 $h^{-1}$. The amount of hydrogen mixed with the feedstock is preferably between 50 and 5000 normal cubic meters ($Nm^3$) per cubic meter ($m^3$) of liquid feedstock, preferably between 100 and 2000 $Nm^3/m^3$ and very preferably between 200 and 1000 $Nm^3/m^3$.

Since the initial hydroconversion steps ($a_1$) are performed in a fixed bed, in a moving bed, in an ebullated bed and/or in a hybrid bed depending on the feedstock to be treated, this step thus contains at least one hydroconversion catalyst that is kept in the reactor.

The hydroconversion catalyst used in the initial hydroconversion step ($a_1$) of the process according to the invention may contain one or more elements from Groups 4 to 12 of the Periodic Table of the Elements, which may or may not be deposited on a support. Use may advantageously be made of a catalyst comprising a support, preferably an amorphous support, such as silica, alumina, silica/alumina, titanium dioxide or combinations of these structures, and very preferably alumina.

The catalyst may contain at least one metal from Group VIII chosen from nickel and cobalt, preferably nickel, said element from Group VIII preferably being used in combination with at least one metal from Group VIB chosen from molybdenum and tungsten; preferably, the metal from Group VIB is molybdenum.

In the present description, the groups of chemical elements are given according to the CAS classification (CRC Handbook of Chemistry and Physics, published by CRC Press, Editor in Chief D. R. Lide, 81st edition, 2000-2001). For example, Group VIII according to the CAS classification corresponds to the metals of columns 8, 9 and 10 according to the new IUPAC classification.

Advantageously, the hydroconversion catalyst used in the initial hydroconversion step ($a_1$) comprises an alumina support and at least one metal from Group VIII chosen from nickel and cobalt, preferably nickel, and at least one metal from Group VIB chosen from molybdenum and tungsten, preferably molybdenum. Preferably, the hydroconversion catalyst comprises nickel as element from Group VIII and molybdenum as element from Group VIB.

The content of metal from the non-noble group VIII, in particular of nickel, is advantageously between 0.5% and 10%, expressed as weight of metal oxide (in particular NiO), and preferably between 1% and 6% by weight, and the content of metal from group VIB, in particular of molybdenum, is advantageously between 1% and 30%, expressed as weight of metal oxide (in particular of molybdenum trioxide $MoO_3$), and preferably between 4% and 20% by weight. The contents of metals are expressed as weight percentage of metal oxide relative to the weight of the catalyst.

This catalyst is advantageously used in the form of extrudates or of beads. The beads have, for example, a diameter of between 0.4 mm and 4.0 mm. The extrudates have, for example, a cylindrical form with a diameter of between 0.5 and 4.0 mm and a length of between 1 and 5 mm. The extrudates may also be objects of a different shape such as trilobes, regular or irregular tetralobes, or other multilobes. Catalysts of other forms may also be used.

The size of these various forms of catalysts may be characterized by means of the equivalent diameter. The equivalent diameter is defined as six times the ratio between the volume of the particle and the external surface area of the particle. The catalyst used in the form of extrudates, beads or other forms thus has an equivalent diameter of between 0.4 mm and 4.4 mm. These catalysts are well known to those skilled in the art.

In one of the embodiments according to the invention, the initial hydroconversion step ($a_1$) is performed in a hybrid bed, simultaneously including at least one catalyst which is maintained in the reactor and at least one entrained catalyst which enters the reactor with the feedstock and which is entrained out of the reactor with the effluents. In this case, a type of entrained catalyst, also known as a "slurry", is thus used in addition to the hydroconversion catalyst which is maintained in the ebullated-bed reactor. The difference of the entrained catalyst is that its particle size and density are suitable for the entrainment thereof. The term "entrainment of the dispersed catalyst" means the circulation thereof in the three-phase reactor(s) by the liquid streams, said catalyst circulating with the feedstock in said three-phase reactor(s), and being withdrawn from said three-phase reactor(s) with the liquid effluent produced. These catalysts are well known to a person skilled in the art.

The entrained catalyst may advantageously be obtained by injection of at least one active-phase precursor directly into the hydroconversion reactor(s) and/or into the feedstock prior to the introduction of said feedstock into the hydroconversion step(s). The addition of precursor may be introduced continuously or batchwise (depending on the operation, on the type of feedstocks treated, on the desired product specifications and on the operability). According to one or more embodiments, the entrained catalyst precursor(s) are premixed with a hydrocarbon oil composed for example of hydrocarbons of which at least 50% by weight relative to the total weight of the hydrocarbon oil have a boiling point of between 180° C. and 540° C., to form a dilute precursor premix. According to one or more embodiments, the precursor or the dilute precursor premix is dispersed in the heavy hydrocarbon feedstock, for example by dynamic mixing (for example using a rotor, a stirrer, and the like) or by static mixing (for example using an injector, by force feeding, via a static mixer, and the like), or merely added to the feedstock to obtain a mixture. Any mixing and stirring technique known to a person skilled in the art may be used to disperse the precursor or the dilute precursor mixture in the feedstock of one or more hydroconversion steps.

Said active-phase precursor(s) of the unsupported catalyst may be in liquid form, for instance precursors of metals which are soluble in organic media, for instance molybdenum octoates and/or molybdenum naphthenates, or water-soluble compounds, for instance phosphomolybdic acids and/or ammonium heptamolybdates.

Said entrained catalyst may be formed and activated ex situ, outside the reactor, under conditions suitable for the activation, and then injected with the feedstock. Said entrained catalyst may also be formed and activated in situ, under the reaction conditions of one of the hydroconversion steps.

According to one embodiment, said entrained catalyst may be supported. In this case, the supported catalyst may advantageously be obtained:

- by grinding fresh or spent supported hydroconversion catalyst or by grinding a mixture of fresh and spent catalysts, or
- by impregnation of at least one active-phase precursor on a support having a particle size suitable for the entrainment thereof and preferably a size of between 0.001 and 100 μm. The active phase may be the phase described above for the hydroconversion catalyst used in the initial hydroconversion step ($a_1$), and likewise as regards the support. Their description is not repeated here.

In one of the embodiments of the process according to the invention, a different hydroconversion catalyst is used in each reactor of this initial hydroconversion step ($a_1$), the catalyst proposed for each reactor being suited to the feedstock sent to this reactor.

In one of the embodiments of the process according to the invention, several types of catalysts are used in each reactor.

In one of the embodiments of the process according to the invention, each reactor contains one or more catalysts suitable for ebullated-bed operation, and optionally one or more additional entrained catalysts.

As is known, and described, for example, in patent FR 3 033 797, when it is spent, the hydroconversion catalyst may be partly replaced with fresh catalyst, and/or with spent catalyst which has higher catalytic activity than the spent catalyst to be replaced, and/or with regenerated catalyst, and/or with rejuvenated catalyst (catalyst obtained from a rejuvenation zone in which the majority of the deposited metals are removed, before sending the spent rejuvenated catalyst to a regeneration zone in which the carbon and sulfur it contains are removed, thus increasing the activity of the catalyst), by withdrawing the spent catalyst preferably at the bottom of the reactor, and by introducing replacement catalyst either at the top or at the bottom of the reactor. This replacement of spent catalyst is preferably performed at regular time intervals, and preferably portionwise or virtually continuously. The replacement of spent catalyst may be totally or partly done with spent and/or regenerated and/or rejuvenated catalyst obtained from the same reactor and/or from another reactor of any hydroconversion step. The catalyst may be added with the metals in the form of metal oxides, with the metals in the form of metal sulfides, or after preconditioning. For each reactor, the degree of replacement of the spent hydroconversion catalyst with fresh catalyst is advantageously between 0.01 kg and 10 kg per cubic meter of feedstock treated and preferably between 0.1 kg and 3 kg per cubic meter of feedstock treated. This withdrawing and this replacement are performed using devices which advantageously make possible the continuous functioning of this hydroconversion step.

As regards the at least partial replacement with regenerated catalyst, it is possible to send the spent catalyst withdrawn from the reactor to a regeneration zone, in which the carbon and the sulfur which it contains are removed, and then to return this regenerated catalyst to the hydroconversion step. As regards the at least partial replacement with rejuvenated catalyst, it is possible to send the spent catalyst withdrawn from the reactor to a rejuvenation zone, in which most of the metals deposited are removed, before sending the spent and rejuvenated catalyst to a regeneration zone, in which the carbon and the sulfur which it contains are removed, and then to return this regenerated catalyst to the hydroconversion step.

The initial hydroconversion section $A_1$ may also receive, in addition to the heavy hydrocarbon feedstock, at least one of the following effluents:

- one or more external hydrocarbon feedstocks (in the sense external to the process according to the invention and different from the initial feedstock), preferably hydrocarbon cuts external to the process, such as atmospheric distillates, vacuum distillates, atmospheric residues or vacuum residues;
- a portion of the heavy fraction resulting from one or more intermediate separation steps ($b_j$) performed between two consecutive additional hydroconversion steps ($a_i$), these steps ($a_i$) and ($b_j$) being described below;
- a portion or all of one or more intermediate fractions resulting from one or more intermediate separation steps ($b_j$) performed between two consecutive additional hydroconversion steps ($a_i$);
- a portion of the effluent of one or more additional hydroconversion steps ($a_i$);
- a portion of the heavy cut and/or of one or more intermediate cuts and/or of one or more light cuts resulting from the first fractionation step (c) of the process according to the invention;
- a portion or all of the residual asphalt produced in the deasphalter D in the deasphalting step (d);
- a portion or all of the light fraction of the DAO produced in the second fractionation step (e) of the process according to the invention.

Intermediate Separation Step ($b_1$)—Optional

The liquid effluent resulting from the initial hydroconversion step ($a_1$) may then undergo an intermediate separation step ($b_1$) in an intermediate separation section ($b_1$), performed between the initial hydroconversion step ($a_1$) and an additional hydroconversion step following the initial hydroconversion step. This additional hydroconversion step is described below. According to the invention, this intermediate separation step ($b_1$) is preferred, but it remains optional. Specifically, the liquid effluent resulting from the initial hydroconversion step ($a_1$) may alternatively be sent directly to the additional hydroconversion step.

Preferably, at least one portion of the liquid effluent resulting from the initial hydroconversion step ($a_1$) is sent to the intermediate separation step ($b_1$).

The intermediate separation step ($b_1$) separates a portion or all of the liquid effluent resulting from the initial hydroconversion step ($a_1$) in order to produce at least one so-called heavy liquid fraction that boils predominantly at a temperature greater than or equal to 350° C.

This first intermediate separation step therefore produces at least two fractions, including the heavy liquid fraction as described above, the other cut(s) being light and intermediate cut(s).

The light fraction thus separated contains dissolved light gases ($H_2$ and $C_1$-$C_4$), naphtha (fraction that boils at a temperature below 150° C.), kerosene (fraction that boils between 150° C. and 250° C.), and at least one portion of the diesel (fraction that boils between 250° C. and 375° C.).

The light fraction may then be sent at least partly to a fractionating unit (not represented in the figures) where the light gases ($H_2$ and $C_1$-$C_4$) are extracted from said light fraction, for example by passing through a flash drum. The gaseous hydrogen thus recovered may advantageously be recycled into the inlet of the initial hydroconversion step ($a_1$).

The fractionating unit where the light fraction may be sent may also comprise a distillation column. In this case, the naphtha, kerosene and diesel fractions of the light fraction sent to said column are separated.

The heavy liquid fraction resulting from the intermediate separation step ($b_1$), that boils predominantly at a temperature greater than or equal to 350° C., contains at least one fraction that boils at a temperature greater than or equal to 540° C., referred to as vacuum residue (which is the unconverted fraction). The heavy liquid fraction resulting from the intermediate separation step ($b_1$), that boils predominantly at a temperature greater than or equal to 350° C., may also contain a fraction that boils between 375° C. and 540° C., referred to as vacuum distillate. It may optionally also contain a portion of the diesel fraction that boils between 250° C. and 375° C.

This heavy liquid fraction is then sent, completely or partly, to a second hydroconversion step ($a_2$), as described below.

The intermediate separation step ($b_1$) may therefore separate the liquid effluent resulting from the initial hydroconversion step ($a_1$) into more than two liquid fractions, depending on the separation means used.

The intermediate separation section $B_1$ comprises any separation means known to a person skilled in the art.

The intermediate separation section $B_1$ may thus comprise one or more of the following items of separation equipment: one or more flash drums arranged in series, one or more steam- or hydrogen-stripping columns, an atmospheric distillation column, a vacuum distillation column.

Preferably, this intermediate separation step ($b_1$) is performed with one or more flash drums arranged in series.

According to a preferred embodiment, the intermediate separation step ($b_1$) is performed with a single flash drum. Preferably, the flash drum is at a pressure and a temperature that are close to the operating conditions of the last reactor of the initial hydroconversion step ($a_1$). This implementation is preferred in particular since it makes it possible to reduce the number of items of equipment and therefore the investment cost.

According to another embodiment, the intermediate separation step ($b_1$) is performed by a series of several flash drums, operating at operating conditions different to those of the last reactor of the initial hydroconversion step ($a_1$), and resulting in the obtention of at least the light liquid fraction, which may then be sent at least partly to a fractionation unit, and of at least the heavy liquid fraction, which is then sent at least partly to a second hydroconversion step ($a_2$).

In another embodiment, the intermediate separation step ($b_1$) is performed with one or more steam- and/or hydrogen-stripping columns. By this means, the effluent resulting from the initial hydroconversion step ($a_1$) is separated into at least the light liquid fraction and at least the heavy liquid fraction. The heavy liquid fraction is then sent at least partly to a second hydroconversion step ($a_2$).

In another embodiment, the intermediate separation step ($b_1$) is performed in an atmospheric distillation column separating the liquid effluent resulting from the initial hydroconversion step ($a_1$). The heavy liquid fraction recovered from the atmospheric distillation column is then sent at least partly to a second hydroconversion step ($a_2$).

In another embodiment, the intermediate separation step ($b_1$) is performed by an atmospheric distillation column separating the liquid effluent resulting from the initial hydroconversion step ($a_1$), and by a vacuum distillation column that receives the residue from the atmospheric distillation column and that produces the heavy liquid fraction which is then sent at least partly to a second hydroconversion step ($a_2$).

The intermediate separation step ($b_1$) may also consist of a combination of the various embodiments described above, in an order different from that described above.

Optionally, before being sent to a second hydroconversion step ($a_2$) according to the invention, the heavy liquid fraction may be subjected to a steam- and/or hydrogen-stripping step with the aid of one or more stripping columns, in order to eliminate, from the heavy fraction, the compounds with a boiling point below 540° C.

The intermediate separation section $B_1$ may also receive, in addition to a portion or all of the liquid effluent resulting from the initial hydroconversion step ($a_1$), at least one of the following effluents:

- a portion of the heavy hydrocarbon feedstock sent to the hydroconversion step (bypass);
- one or more external hydrocarbon feedstocks, preferably hydrocarbon cuts external to the process, such as atmospheric distillates, vacuum distillates, atmospheric residues, vacuum residues;
- a portion of the heavy fraction resulting from one or more intermediate separation steps $B_1$ performed between two consecutive additional hydroconversion steps ($a_i$), after step ($a_1$), as described in detail below;
- a portion or all of one or more intermediate fractions resulting from one or more intermediate separation steps ($b_j$) performed between two consecutive additional hydroconversion steps ($a_i$);
- a portion of the liquid effluent of one or more additional hydroconversion steps ($a_i$) described below;
- a portion of the heavy cut and/or of one or more intermediate cuts and/or of one or more light cuts resulting from the first fractionation step (c) described in detail below;
- a portion or all of the DAO produced in the deasphalter D in the deasphalting step (d);
- a portion or all of the heavy fraction of the DAO produced in the second fractionation step (e);
- a portion or all of the light fraction of the DAO produced in the second fractionation step (e).

In this case, the additional effluent may be sent to the inlet of the intermediate separation section, or between two different items of equipment of the intermediate separation section, for example between the flash drums, the stripping columns and/or the distillation columns.

Additional Hydroconversion Step(s) ($a_i$) and Optional Intermediate Separation Step(s) ($b_j$)

In accordance with the invention, a portion or all of the effluent resulting from the initial hydroconversion step ($a_1$), preferably a portion or all of the heavy fraction resulting from the intermediate separation step ($b_1$), is treated in the presence of hydrogen in an additional hydroconversion step ($a_2$) performed in an additional hydroconversion section $A_2$, which follows the initial hydroconversion step ($a_1$) or optionally the intermediate separation step ($b_1$).

The process according to the invention may comprise more than one additional hydroconversion step ($a_i$), and also more than one intermediate separation step ($b_j$) between two consecutive additional hydroconversion steps ($a_i$).

Thus, the process according to the invention comprises (n−1) additional hydroconversion step(s) ($a_i$) in (n−1) additional hydroconversion section(s) $A_i$, in the presence of hydrogen, of at least a portion or all of the liquid effluent resulting from the preceding hydroconversion step ($a_{i-1}$) or optionally of a heavy fraction resulting from an optional intermediate separation step ($b_j$) between two consecutive hydroconversion steps separating a portion or all of the liquid effluent resulting from the preceding hydroconversion step ($a_{i-1}$) in order to produce at least one heavy fraction that boils predominantly at a temperature greater than or equal to 350° C., the (n−1) additional hydroconversion step(s) ($a_i$) being performed so as to obtain a hydroconverted liquid effluent having a reduced content of sulfur, of Conradson carbon, of metals and of nitrogen.

n is the total number of hydroconversion steps, with n greater than or equal to 2.

i and j are subscripts. i is an integer ranging from 2 to n and j being an integer ranging from 1 to (n−1).

The additional hydroconversion section(s) $A_i$ each include at least one three-phase reactor containing at least one hydroconversion catalyst, as described for the initial hydroconversion section $A_1$.

The initial hydroconversion step and the additional hydroconversion step(s) are separate steps, performed in different hydroconversion sections.

The (n−1) additional hydroconversion step(s) ($a_i$) are performed in a manner similar to that which was described for the initial hydroconversion step, and their description is not therefore repeated here. This applies notably for the operating conditions, the equipment used, the hydroconversion catalysts used, with the exception of the specifications given below.

As for the initial hydroconversion step ($a_1$), the (n−1) additional hydroconversion step(s) ($a_i$) are advantageously performed in initial hydroconversion sections $A_1$ including one or more three-phase hydroconversion reactors, which may be in series and/or in parallel, with ebullated-bed operation, as described above for the initial hydroconversion step ($a_1$). According to this preferred embodiment, each three-phase reactor is operated as a fluidized bed, known as an ebullated bed. Each reactor advantageously includes a recirculation pump which makes it possible to maintain the catalyst in an ebullated bed by continuous recycling of at least a portion of a liquid fraction advantageously withdrawn at the top of the reactor and reinjected at the bottom of the reactor.

In these additional hydroconversion steps, the operating conditions may be more severe than in the initial hydroconversion step, in particular by using a higher reaction temperature, remaining within the range between 300° C. and 550° C., preferably between 350° C. and 500° C., and more preferably between 370° C. and 450° C., or else by reducing the amount of hydrogen introduced into the reactor, remaining within the range between 50 and 5000 $Nm^3/m^3$ of liquid feedstock, preferably between 100 and 2000 $Nm^3/m^3$, and even more preferably between 200 and 1000 $Nm^3/m^3$. The other pressure and HSV parameters are within ranges identical to those described for the initial hydroconversion step.

The catalyst used in the reactor(s) of an additional hydroconversion step may be the same as that used in the reactor(s) of the initial hydroconversion step, or may also be a catalyst more suitable for the hydroconversion of residual cuts containing a DAO. In this case, the catalyst may have a porosity of the support or contain contents of metals, suitable for the hydroconversion of feedstocks containing DAO cuts.

As regards the possible replacement of the spent catalyst, the degree of replacement of catalyst applied in the reactor(s) of an additional hydroconversion step may be the same as that used in the reactor(s) of the initial hydroconversion step, or may be more suitable for the hydroconversion of residual cuts containing a DAO. In this case, the degree of replacement of the catalyst may be lower, suitable for the hydroconversion of feedstocks containing DAO cuts.

The other intermediate separation steps ($b_j$) that may each be performed between two consecutive additional hydroconversion steps $A_i$ are also performed in a manner similar to that which was described for the intermediate separation step ($b_1$), and the description of these steps ($b_j$) is therefore not repeated here.

In one preferred embodiment, the process according to the invention always comprises an intermediate separation step ($b_j$) between two consecutive additional hydroconversion steps ($a_i$). According to one alternative embodiment, the effluent resulting from an additional hydroconversion step ($a_i$) is directly sent to another additional hydroconversion step ($a_{i+1}$) following the step ($a_i$).

According to one preferred embodiment, the process comprises a single additional hydroconversion step ($a_2$), and an intermediate separation step ($b_1$). With reference to figures in particular, this is the case where n is equal to 2, with i taking the sole value of 2 and j the sole value of 1.

In accordance with the invention, at least one portion of the DAO resulting from the deasphalting step (d) described in detail below, and/or at least one portion of the heavy fraction of the DAO resulting from a second fractionation step (e) also described in detail below, is recycled by being sent to an additional hydroconversion step ($a_i$) and/or to an intermediate separation step ($b_j$). The process according to the invention thus excludes recycling of the DAO or of a heavy fraction of the DAO into the initial hydroconversion step.

The DAO or the heavy fraction of the DAO thus recycled may then be cotreated in an additional hydroconversion section $A_i$ with at least one portion of the effluent originating from the initial hydroconversion step ($a_1$) or from an additional hydroconversion step (as), or more preferably cotreated with at least one portion of the heavy fraction resulting from an intermediate separation step ($b_j$).

Each additional hydroconversion section $A_i$ may also receive, in addition to the effluent resulting from the initial hydroconversion step or from a preceding additional hydroconversion step ($a_{i-1}$) or else, preferably, in addition to the heavy fraction resulting from an intermediate separation step ($b_j$), at least one of the following effluents:

- a portion of the heavy hydrocarbon feedstock sent to the initial hydroconversion step (bypass);
- one or more external hydrocarbon feedstocks, preferably hydrocarbon cuts external to the process, such as atmospheric distillates, vacuum distillates, atmospheric residues or vacuum residues;
- a portion of the heavy fraction resulting from one or more subsequent intermediate separation steps $B_j$ performed between two consecutive additional hydroconversion steps ($a_i$);
- a portion or all of one or more intermediate fractions resulting from one or more subsequent intermediate separation steps ($b_j$) performed between two consecutive additional hydroconversion steps ($a_i$);
- a portion of the effluent of one or more subsequent additional hydroconversion hydroconversion steps ($a_{i+1}$);
- a portion of the heavy cut and/or of one or more intermediate cuts and/or of one or more light cuts resulting from the first fractionation step (c) of the process according to the invention;
- a portion or all of the DAO produced in the deasphalter D in the deasphalting step (d);
- a portion or all of the heavy fraction of the DAO produced in the second fractionation step (e) of the process according to the invention;
- a portion or all of the light fraction of the DAO produced in the second fractionation step (e);
- a portion or all of the residual asphalt produced in the deasphalter D in the deasphalting step (d).

Each intermediate separation section $B_1$ may also receive, in addition to a portion or all of the hydroconverted liquid effluent resulting from the initial hydroconversion step ($a_1$) or from a preceding additional hydroconversion step ($a_{i-1}$), at least one of the following effluents:

- a portion of the heavy hydrocarbon feedstock sent to the hydroconversion step (bypass);
- one or more external hydrocarbon feedstocks, preferably hydrocarbon cuts external to the process, such as atmospheric distillates, vacuum distillates, atmospheric residues, vacuum residues;
- a portion of the heavy fraction resulting from one or more subsequent intermediate separation steps $B_j$ performed between two consecutive additional hydroconversion steps ($a_i$);
- a portion or all of one or more intermediate fractions resulting from one or more subsequent intermediate separation steps ($b_j$) performed between two consecutive additional hydroconversion steps ($a_i$);

a portion of the liquid effluent of one or more subsequent additional hydroconversion steps ($a_i$);

a portion of the heavy cut and/or of one or more intermediate cuts and/or of one or more light cuts resulting from the first fractionation step (c);

a portion or all of the DAO produced in the deasphalter D in the deasphalting step (d);

a portion or all of the heavy fraction of the DAO produced in the second fractionation step (e);

a portion or all of the light fraction of the DAO produced in the second fractionation step (e).

In this case, the additional effluent may be sent to the inlet of the intermediate separation section $B_j$, or between two different items of equipment of the intermediate separation section $B_j$, for example between the flash drums, the stripping columns and/or the distillation columns.

First Fractionation Step (c)

The hydroconverted liquid effluent resulting from the last additional hydroconversion step ($a_n$) then undergoes, at least partly, a fractionation step (c) in a first fractionation section C.

This first fractionation step (c) separates a portion or all of the effluent resulting from step ($a_n$) into several fractions, including at least one heavy liquid cut that boils predominantly at a temperature above 350° C., preferably above 500° C. and preferably above 540° C. The heavy liquid cut contains a fraction that boils at a temperature above 540° C., referred to as vacuum residue (which is the unconverted fraction). It may contain a portion of the diesel fraction that boils between 250° C. and 375° C. and a fraction that boils between 375° C. and 540° C. referred to as vacuum distillate.

This first fractionation step therefore produces at least two fractions, including the heavy liquid fraction as described above, the other cut(s) being light and intermediate cut(s).

The first fractionation section C comprises any separation means known to a person skilled in the art.

The first fractionation section C may thus comprise one or more of the following items of separation equipment: one or more flash drums arranged in series, and preferably a series of at least two successive flash drums, one or more steam- and/or hydrogen-stripping columns, an atmospheric distillation column, a vacuum distillation column.

According to one embodiment, this first fractionation step (c) is performed by a series of at least two successive flash drums.

According to another embodiment, this first fractionation step (c) is performed by one or more steam- and/or hydrogen-stripping columns.

According to another preferred embodiment, this first fractionation step (c) is performed by an atmospheric distillation column, and more preferentially by an atmospheric distillation column and a vacuum column that receives the atmospheric residue.

According to most preferred embodiment, this first fractionation step (c) is performed by one or more flash drums, an atmospheric distillation column and a vacuum column that receives the atmospheric residue. This configuration makes it possible to reduce the size of the deasphalter downstream, thus minimizing the investment costs and the operating costs.

The first fractionation section C may also receive, in addition to a portion or all of the hydroconverted liquid effluent resulting from the last additional hydroconversion step ($a_n$), at least one of the following effluents:

a portion of the heavy hydrocarbon feedstock sent to the hydroconversion step (bypass);

one or more external hydrocarbon feedstocks, preferably hydrocarbon cuts external to the process, such as atmospheric distillates, vacuum distillates, atmospheric residues, vacuum residues;

a portion of the heavy fraction resulting from one or more intermediate separation steps $B_j$ performed between two consecutive additional hydroconversion steps ($a_i$);

a portion of the liquid effluent of one or more additional hydroconversion steps ($a_i$);

a portion of one or more of the intermediate cuts resulting from the first fractionation step (c);

a portion of the DAO produced in the deasphalter D in the deasphalting step (d);

a portion of the heavy fraction of the DAO produced in the second fractionation step (e);

a portion or all of the light fraction of the DAO produced in the second fractionation step (e).

In this case, the additional effluent may be sent to the inlet of the intermediate separation section, or between two different items of equipment of the intermediate separation section, for example between the flash drums, the stripping columns and/or the distillation columns.

Deasphalting Step (d)

The heavy cut resulting from the first fractionation step (c) then undergoes, in accordance with the process according to the invention, partly or completely, a deasphalting step (d) in a deasphalter D, with at least one hydrocarbon solvent, in order to extract a DAO and a residual asphalt.

The deasphalter D may also receive at least one of the following effluents:

a portion of the heavy hydrocarbon feedstock sent to the hydroconversion step (bypass);

one or more external hydrocarbon feedstocks, preferably hydrocarbon cuts external to the process, such as atmospheric distillates, vacuum distillates, atmospheric residues, vacuum residues;

a portion of the heavy fraction resulting from one or more intermediate separation steps ($b_j$) performed between two consecutive additional hydroconversion steps ($a_i$) (not shown in FIG. 1);

a portion of the liquid effluent of the initial hydroconversion step ($a_1$) or of one or more additional hydroconversion steps ($a_i$) (not represented in FIG. 1);

The deasphalting step (d) with the aid of a solvent (or SDA for solvent deasphalting) is performed under conditions well known to a person skilled in the art. Reference may thus be made to the article by Billon et al. published in 1994 in volume 49, No. 5 of the Revue de l'Institut Français du Pétrole, pages 495 to 507, to the book "Raffinage et conversion des produits lourds du pétrole" [Refining and conversion of heavy petroleum products], by J F Le Page, S G Chatila and M Davidson, Edition Technip, pages 17-32 or to patents U.S. Pat. Nos. 4,239,616; 4,354,922; 4,354,928; 4,440,633; 4,536,283; and 4,715,946.

The deasphalting may be performed in one or more mixer-settlers or in one or more extraction columns. The deasphalter D thus comprises at least one mixer-settler or at least one extraction column.

The deasphalting is a liquid-liquid extraction generally performed at an average temperature between 60° C. and 250° C. with at least one hydrocarbon solvent. The solvents used for the deasphalting are solvents with a low boiling point, preferably paraffinic solvents, and preferably solvents heavier than propane, and preferably containing from 3 to 7 carbon atoms. The preferred solvents include propane, butane, isobutane, pentane, isopentane, neopentane, hexane, isohexanes, $C_6$ hydrocarbons, heptane, $C_7$ hydrocarbons, light petroleums that are more or less apolar, and also mixtures obtained from the aforementioned solvents. Preferably, the solvent is butane, pentane or hexane, and also mixtures thereof. At least one additive is optionally added to the solvent(s). The solvents that may be used and the additives are widely described in the literature. The (volume/volume) solvent/feedstock ratios incorporated into the deasphalter D are generally between 3/1 and 16/1, and preferably between 4/1 and 8/1. It is also possible and advantageous to carry out the recovery of the solvent according to the opticritical process, that is to say by using a solvent under supercritical conditions in the separation section. This process makes it possible in particular to considerably improve the overall economics of the process.

Within the context the present invention, it is preferred to carry out a technique using at least one extraction column and preferably only one (for example the Solvahl™ process). Advantageously, such as in the Solvahl™ process with a single extraction column, the (volume/volume) solvent/feedstock ratios incorporated into the deasphalter D are low, typically between 4/1 and 8/1, or even between 4/1 and 6/1.

According to one preferred embodiment, the deasphalting is performed in an extraction column at a temperature of between 60° C. and 250° C. with at least one hydrocarbon solvent containing from 3 to 7 carbon atoms, and a (volume/volume) solvent/feedstock ratio of between 4/1 and 6/1.

The deasphalter D produces a DAO that is practically free of $C_7$ asphaltenes and a residual asphalt that concentrates most of the impurities of the residue, said residual asphalt being drawn off.

The DAO yield is generally between 40% by weight and 95% by weight depending on the operating conditions and the solvent used, and depending on the feedstock sent to the deasphalter D and in particular the quality of the heavy liquid cut resulting from the first fractionation step (c).

Table 1 below gives the ranges of the typical operating conditions for the deasphalting as a function of the solvent:

TABLE 1

| Solvent | Propane | Butane | Pentane | Hexane | Heptane |
|---|---|---|---|---|---|
| Pressure, MPa | 3-5 | 3-4 | 2-4 | 2-4 | 2-4 |
| Temperature, ° C. | 45-110 | 80-160 | 140-210 | 150-230 | 160-280 |
| Solvent/Feedstock Ratio, v/v | 6-10 | 5-8 | 3-6 | 3-6 | 3-6 |

The conditions of the deasphalting are adapted to the quality of the DAO to be extracted and to the feedstock entering the deasphalter D.

These conditions enable a significant reduction in the content of sulfur, of Conradson carbon and of the content of $C_7$ asphaltenes.

The DAO obtained advantageously has a content of $C_7$ asphaltenes of less than 2% by weight in general, preferably of less than 0.5% by weight, preferably of less than 0.05% by weight measured as $C_7$ insolubles.

In accordance with the invention the DAO thus produced is either sent to a second fractionation step (e) of the process according to the invention, or recycled at least partly into one or more of the intermediate separation steps ($b_j$) and/or directly into the inlet of one or more additional hydroconversion steps ($a_i$), and more preferably into the inlet of the last additional hydroconversion step ($a_n$).

Second Fractionation Step (e)—Optional

The DAO resulting from the deasphalting step (d) may undergo, at least in part, a second fractionation in a second fractionation section E, in order to produce at least two fractions.

Preferably, a portion or all of the DAO resulting from the deasphalting step (d) is sent to this second fractionation step (e).

The second fractionation section E comprises any separation means known to a person skilled in the art.

The second fractionation section E may thus comprise one or more of the following items of separation equipment: one or more flash drums arranged in series, and preferably a series of at least two successive flash drums, one or more steam- and/or hydrogen-stripping columns, an atmospheric distillation column, a vacuum distillation column.

According to one embodiment, this second fractionation step (e) is performed by a series of at least two successive flash drums.

According to another embodiment, this second fractionation step (e) is performed by one or more steam- and/or hydrogen-stripping columns.

According to another preferred embodiment, this second fractionation step (e) is performed with an atmospheric distillation column, and more preferentially with an atmospheric distillation column and a vacuum column that receives the atmospheric residue.

According to another preferred embodiment, this second fractionation step (e) is performed with one or more flash drums, an atmospheric distillation column and a vacuum column that receives the atmospheric residue.

According to another preferred embodiment, this second fractionation step (e) is performed with a vacuum column.

The choice of equipment of the fractionation section E depends preferably on the choice of the equipment of the first fractionation section C and on the feedstocks introduced into the deasphalter D.

According to the process of the invention, the heavy fraction of the DAO thus produced in the second fractionation section E is then recycled at least partly into one or more intermediate separation steps and/or directly into the inlet of one or more additional hydroconversion steps ($a_i$), and more preferably into the inlet of the last additional hydroconversion step ($a_n$).

According to one preferred embodiment, the heavy cut resulting from the first fractionation section C of the process according to the invention is an atmospheric residue which is released from an atmospheric distillation column. The absence of a vacuum distillation column makes it possible to avoid the concentration of the sediments and the rapid fouling of the vacuum distillation column. The atmospheric residue thus produced is then sent to the deasphalter D in order to carry out the deasphalting step (d), producing a residual asphalt and a DAO that is virtually free of $C_7$ asphaltenes and sediments, but that contains both a vacuum distillate fraction and a vacuum residue fraction. This DAO thus obtained may then be sent to the second fractionation section E of the process according to the invention, composed of a vacuum distillation column and having the objective of separating the DAO into at least one light fraction of the DAO, the boiling point of which is predominantly below 500° C., and at least one heavy fraction of the DAO, the boiling point of which is predominantly above 500° C. As the DAO produced in the deasphalter D is free of sediments and virtually no longer contains any $C_7$ asphaltenes, the vacuum distillation column will only foul up very slowly, thus avoiding the frequent shutdowns and decommissionings for the cleaning of the vacuum distillation column. The heavy fraction of the DAO thus produced is then advantageously recycled at least partly into the inlet of the last additional hydroconversion step ($a_n$).

The process according to the invention therefore improves the stability of the liquid effluents treated during the hydroconversion, and more particularly during the additional hydroconversion steps receiving at least one portion of the DAO and/or of the heavy fraction of the DAO, while considerably increasing the conversion of the heavy hydrocarbon feedstock.

Step of Recycling the DAO or the Heavy Fraction of the DAO (f)

The process according to the invention comprises the recycling of at least one portion of the DAO resulting from step (d) and/or of at least one portion of the heavy fraction of the DAO resulting from step (e) into an additional hydroconversion step ($a_i$) and/or into an intermediate separation step ($b_j$).

This recycling has been described above in connection with the deasphalting step (d) and the second fractionation step (e).

Step of Recycling ($r_1$ to $r_7$) Other Effluents Resulting from Steps (e)

The process according to the invention may comprise other recyclings, it being possible for the recycled effluents to result from the second fractionation step (e), from the deasphalting step (d), from an additional hydroconversion step ($a_i$), or from an intermediate separation step ($b_j$).

According to one embodiment, the process comprises the recycling ($r_1$) of a portion or all of the light fraction of the DAO resulting from step (e) into the initial hydroconversion section $A_1$ and/or into at least one additional hydroconversion section A; and/or into at least one intermediate separation section $B_j$ and/or into the first fractionation section C.

According to one embodiment, the process comprises the recycling ($r_2$) of a portion of the heavy fraction of the DAO resulting from step (e) into the first fractionation section C.

According to one embodiment, the process comprises the recycling ($r_3$) of a portion of the DAO resulting from step (d) into the first fractionation section C.

According to one embodiment, the process comprises the recycling ($r_4$) of a portion or all of the residual asphalt resulting from step (d) into the initial hydroconversion section $A_1$ and/or into at least one additional hydroconversion section $A_1$. Preferably, the residual asphalt is recycled into a hydroconversion section different from the one that receives the DAO or the heavy fraction of the DAO.

According to one embodiment, the process comprises the recycling ($r_5$) of a portion of the hydroconverted liquid effluent from a given additional hydroconversion section $A_i$:

- into the initial hydroconversion section $A_1$, and/or
- into another additional hydroconversion section $A_i$ positioned upstream of said given section $A_i$, and/or
- into an intermediate separation section $B_j$ positioned upstream of said given section $A_i$.

According to one embodiment, the process comprises the recycling ($r_6$) of a portion of the heavy fraction and/or of a portion or all of one or more intermediate fractions resulting from a given intermediate section $B_1$:

- into the initial hydroconversion section $A_1$, and/or
- into an additional hydroconversion section $A_i$ positioned upstream of said given intermediate section $B_j$, and/or
- into another intermediate separation section $B_j$ positioned upstream of said given section $B_j$.

According to one embodiment, the process comprises the recycling ($r_7$) of a portion of the heavy fraction and/or of a portion or all of one or more intermediate fractions resulting from the first fractionation section C:

- into the initial hydroconversion section $A_1$, and/or
- into an additional hydroconversion section $A_i$, and/or
- into an intermediate separation section $B_j$.

The following embodiments are described with reference to the corresponding figures.

FIG. 1 schematically represents the general case of the process according to the invention, including various options that correspond to various embodiments.

According to the process illustrated in FIG. 1, the heavy hydrocarbon feedstock 1 is sent via a pipe into an initial hydroconversion section $A_1$ composed of one or more three-phase reactors, which may be in series and/or in parallel. These hydroconversion reactors may be, inter alia, reactors of fixed-bed, moving-bed, ebullated-bed and/or hybrid-bed type, depending on the feedstock to be treated, and are preferably reactors with ebullated-bed operation.

The initial hydroconversion step performed in the section $A_1$ represents the first step of hydroconversion of the heavy hydrocarbon feedstock 1, and may include the cotreatment of one or more external feedstocks 2 and/or one or more recycle effluents resulting from other steps of the process.

The various recycle effluents that may be injected into the section $A_1$ are the following:

- a portion of the total effluent (6, 10) resulting from one or more additional hydroconversion sections $A_i$;
- a portion or all of one or more intermediate fractions resulting from one or more intermediate separation sections $B_j$ (not represented in FIG. 1);
- a portion of the heavy fraction resulting from one or more intermediate separation sections $B_j$;
- a portion or all of one or more of the intermediate cuts 12 resulting from the first fractionation section C;
- a portion of the heavy cut 13 resulting from the first fractionation section C;
- a portion or all of the residual asphalt 14 resulting from the deasphalter D;
- a portion or all of the light fraction 16 of the DAO resulting from the second fractionation section E.

The liquid effluent 3 resulting from the initial hydroconversion section $A_1$ may be sent either directly to the additional hydroconversion section $A_2$, or to the intermediate separation section $B_1$ via a pipe. This pipe offers the possibility of purging a fraction of this effluent 3 and therefore of sending either all or only a portion of the liquid effluent resulting from $A_1$ to the intermediate separation section $B_1$.

The section $B_1$ represents the first intermediate separation section where the intermediate separation step ($b_1$) is performed. It receives a portion or all of the liquid effluent from the preceding hydroconversion step $A_1$, optionally with an injection of heavy hydrocarbon feedstock 1 and/or an injection of one or more external feedstocks 2 and/or an injection of one or more recycle effluents. The various recycle effluents that may be injected into the section $B_1$ are:

- a portion of the total effluent (6, 10) resulting from one or more additional hydroconversion sections $A_i$;
- a portion or all of one or more intermediate fractions resulting from one or more intermediate separation sections $B_j$ (not represented in FIG. 1);
- a portion of the heavy fraction 9 resulting from one or more intermediate separation sections $B_j$ downstream;
- a portion or all of one or more of the intermediate cuts 12 resulting from the first fractionation section C;
- a portion of the heavy cut 13 resulting from the first fractionation section C;

- a portion or all of the of the DAO 15 resulting from the deasphalter D;
- a portion or all of the light fraction of the DAO 16 resulting from the second fractionation section E;
- a portion or all of the heavy fraction of the DAO 17 resulting from the second fractionation section E.

The heavy fraction 5 resulting from the first intermediate separation section $B_1$ is then sent at least partly to the additional hydroconversion section $A_2$ via a pipe, whilst the light fraction 4 resulting from the section $B_1$ is purged via another pipe. A purge of the heavy fraction 5 may be performed. It is either a portion or all of the heavy fraction 5 that is sent to the additional hydroconversion section $A_2$. A portion of the effluent 5 may also be recycled into the initial hydroconversion section $A_1$.

The section $A_2$ represents the second hydroconversion section where an additional hydroconversion step ($a_2$) is performed. The section $A_2$ is composed of one or more three-phase reactors, which may be in series and/or in parallel. These hydroconversion reactors may be, inter alia, reactors of fixed-bed, moving-bed, ebullated-bed and/or hybrid-bed type, depending on the feedstock to be treated, and are preferably reactors with ebullated-bed operation.

This section $A_2$ may receive a portion or all of the liquid effluent resulting from the initial hydroconversion section $A_1$ and/or at least a portion of the heavy fraction resulting from the first intermediate separation section $B_1$. This section $A_2$ may also receive, for a co-treatment, a portion of the heavy hydrocarbon feedstock 1 and/or one or more additional feedstocks 2 and/or one or more recycle effluents. The various recycle effluents that may be injected into the section $A_2$ are:

- a portion of the total effluent 10 from one or more additional hydroconversion sections $A_i$ downstream;
- a portion or all of one or more intermediate fractions resulting from one or more intermediate separation sections $B_j$ downstream (not represented in FIG. 1);
- a portion of the heavy fraction 9 resulting from one or more intermediate separation sections $B_j$ downstream;
- a portion or all of one or more of the intermediate cuts 12 resulting from the first fractionation section C;
- a portion of the heavy cut 13 resulting from the first fractionation section C;
- a portion or all of the of the DAO 15 resulting from the deasphalter D;
- a portion or all of the residual asphalt 14 resulting from the deasphalter D;
- a portion or all of the light fraction of the DAO 16 resulting from the second fractionation section E;
- a portion or all of the heavy fraction 17 of the DAO resulting from the second fractionation section E.

The liquid effluent 6 resulting from the second hydroconversion section $A_2$ may be sent to a third hydroconversion section, or to a second intermediate separation section via a pipe which offers the possibility of purging a fraction of said effluent and therefore of sending either all or only a portion of said effluent resulting from the section $A_2$ to the second intermediate separation section $B_2$ (not represented), and also of recycling a portion of said effluent into one or more hydroconversion sections upstream of the section $A_2$ or into the intermediate separation section $B_1$ located between the sections $A_1$ and $A_2$.

The process according to the invention may thus comprise n hydroconversion steps and (n−1) intermediate separation steps.

The section $B_{j=n-i}$ represents the last intermediate separation section. It receives a portion or all of the liquid effluent 7 from the preceding hydroconversion step $A_{i=n-1}$, and optionally an injection of heavy hydrocarbon feedstock 1 and/or an injection of one or more external feedstocks 2 and/or an injection of one or more recycle effluents. The various recycle effluents that may be injected into the section $B_{j=n-1}$ are:

- a portion of the effluent 10 from the last hydroconversion section $A_n$;
- a portion or all of one or more of the intermediate cuts (12) resulting from the first fractionation section C;
- a portion of the heavy cut resulting from the first fractionation section C;
- a portion or all of the of the DAO 15 resulting from the deasphalter D;
- a portion or all of the light fraction of the DAO 16 resulting from the second fractionation section E;
- a portion or all of the heavy fraction of the DAO 17 resulting from the second fractionation section E.

The section $A_n$ represents the last hydroconversion section where the additional hydroconversion step ($a_n$) is performed. The section $A_n$ is composed of one or more three-phase reactors, which may be in series and/or in parallel. These hydroconversion reactors may be, inter alia, reactors of fixed-bed, moving-bed, ebullated-bed and/or hybrid-bed type, depending on the feedstock to be treated, and are preferably reactors with ebullated-bed operation.

This section $A_n$ may receive a portion or all of the effluent from the preceding hydroconversion step $A_{n-1}$ and/or the heavy fraction from the preceding intermediate separation section $B_{j=n-1}$. This section $A_n$ may also receive, for a co-treatment, a portion of the heavy hydrocarbon feedstock 1 and/or one or more external feedstocks 2 and/or one or more recycle effluents. The various recycle effluents that may be injected into the section $A_n$ are:

- a portion or all of one or more of the intermediate cuts 12 resulting from the first fractionation section C;
- a portion of the heavy cut resulting from 13 resulting from the first fractionation section C;
- a portion or all of the residual asphalt 14 resulting from the deasphalter D;
- a portion or all of the of the DAO 15 resulting from the deasphalter D;
- a portion or all of the light fraction of the DAO 16 resulting from the second fractionation section E;
- a portion or all of the heavy fraction of the DAO 17 resulting from the second fractionation section E.

The section C represents the first fractionation section in which all or at least a portion of the hydroconverted liquid effluent 10 resulting from the last hydroconversion section $A_n$ is sent via a pipe in order to be fractionated into several cuts. By way of example, FIG. 1 represents three cuts, a light cut 11, which leaves the process according to the invention and which is optionally sent to a post-treatment, an intermediate cut 12 and a heavy cut 13. These last two cuts may be partially or completely sent to other processes and/or recycled into one or more hydroconversion steps of the process according to the invention and/or recycled into one or to several intermediate separation sections of the process according to the invention.

The first fractionation section C may also receive, either at the inlet or between two different items of equipment making up this section C, a portion of the heavy hydrocarbon feedstock 1 and/or external feedstocks 2 and/or one of the following recycle effluents:

- a portion of the heavy fraction resulting from one or more intermediate separation steps $B_j$ (not represented in FIG. 1);

- a portion of the liquid effluent of one or more hydroconversion steps ($a_1$ and $a_i$) (not represented in FIG. 1);
- a portion of the DAO 15 produced in the deasphalter D;
- a portion of the heavy fraction of the DAO 17 produced in the second fractionation section E;
- a portion or all of the light fraction 16 of the DAO produced in the second fractionation step E.

The section D represents the deasphalter performing the deasphalting step (d) (DAS) in which the DAO 15 and the residual asphalt 14 are at least partly extracted from the heavy cut 13 obtained from the first fractionation section C. The deasphalter D may also receive a portion of the heavy hydrocarbon feedstock 1 and/or of the additional feedstocks 2 and/or one of the following recycling effluents:

- a portion of the heavy fraction resulting from one or more intermediate separation sections B (not represented in FIG. 1);
- a portion of the liquid effluent resulting from the initial hydroconversion section $A_1$ or from one or more additional hydroconversion sections $A_i$ (not represented in FIG. 1);

The DAO produced in the deasphalter D may be either sent, partly or completely, to the second fractionation section E, or recycled, partly or completely, into one or more of the additional hydroconversion sections A and/or into one or more of the intermediate separation sections $B_j$.

The section E represents a second fractionation section of the process according to the invention in which the step of fractionating (e) all or at least one portion of the DAO into at least two cuts is performed. By way of example, the process illustrated in FIG. 1 shows two cuts, a light cut 16, which may leave the process according to the invention and/or be recycled into various sections of the process as described above, and a heavy cut 17. The latter may then be partially or completely recycled into one or more additional hydroconversion sections $A_i$ and/or recycled into one or more intermediate separation sections $B_j$.

The light cut 16 may for example, partly or completely, be used to produce heavy fuel oils, such as bunker fuel oils. The light cut 16 may also, partly or completely, be sent to a conversion step operating with a process chosen from the group formed by fixed-bed hydrocracking, fluidized-bed catalytic cracking and ebullated-bed hydroconversion, it being possible for these processes to include prior hydrotreating.

According to a preferred embodiment, a portion or all of the light cut 16 of the deasphalted fraction DAO is subjected to a fixed-bed hydrocracking, in the presence of hydrogen, under an absolute pressure of between 5 MPa and 35 MPa, at a temperature of advantageously between 300° C. and 500° C., an HSV of between 0.1 $h^{-1}$ and 5 $h^{-1}$ and an amount of hydrogen of between 100 $Nm^3/m^3$ and 1000 $Nm^3/m^3$ (normal cubic meters ($Nm^3$) per cubic meter ($m^3$) of liquid feedstock), and in the presence of a catalyst containing at least one non-noble group VIII element and at least one group VIB element and comprising a support containing at least one zeolite.

According to another preferred embodiment, a portion or all of the light cut 16 of the deasphalted fraction DAO is subjected to a fluid catalytic cracking FCC in the presence of a catalyst, preferably devoid of metals, comprising alumina, silica, silica/alumina, and preferably comprising at least one zeolite.

According to another preferred embodiment, a portion or all of the light cut 16 of the deasphalted fraction DAO is subjected to an ebullated-bed hydroconversion, performed in the presence of hydrogen, under an absolute pressure of between 2 MPa and 35 MPa, at a temperature of between 300° C. and 550° C., an amount of hydrogen of between 50 $Nm^3/m^3$ and 5000 $Nm^3/m^3$ (normal cubic meters ($Nm^3$) per cubic meter ($m^3$) of liquid feedstock), an HSV of between 0.1 $h^{-1}$ and 10 $h^{-1}$ and in the presence of a catalyst containing a support and at least one group VIII metal chosen from nickel and cobalt and at least one group VIB metal chosen from molybdenum and tungsten.

The dotted-line circuit 18 in FIG. 1 represents the numerous possible exchanges of catalyst between the various hydroconversion steps, and also the purge and the addition of fresh and spent catalysts.

Four preferred embodiments of the general diagram from FIG. 1 are illustrated in FIGS. 2 to 5 by increasingly limiting the number of items of equipment and thus the investment costs.

Figure 2:
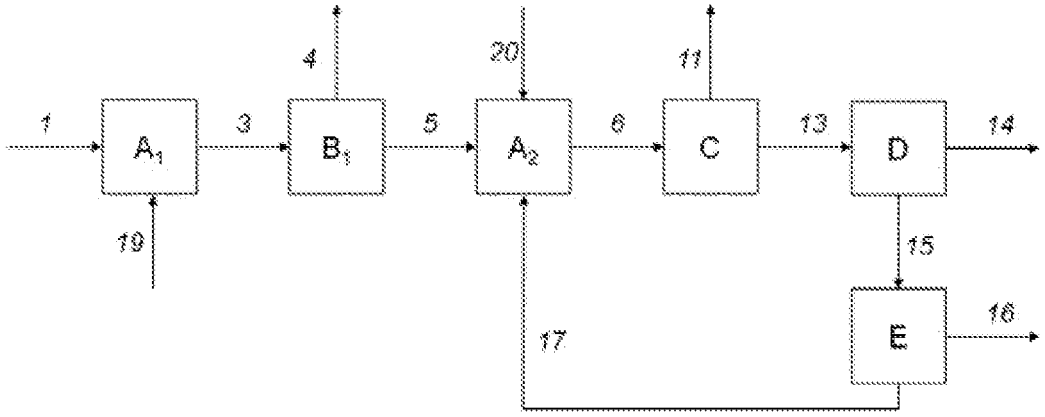
FIG. 2 is a diagram of the process according to a first embodiment in which at least one portion of a heavy fraction of the DAO is recycled into a second hydroconversion section.

FIG. 2 illustrates the invention in a preferred embodiment including the recycling of the heavy fraction of the DAO into the inlet of the last hydroconversion step.

According to this embodiment, the process includes the following successive steps: the initial hydroconversion step ($a_1$), the intermediate separation step ($b_1$), a second hydroconversion step ($a_2$) which is the only additional hydroconversion step, the first fractionation step (c), the deasphalting step (d) and the second fractionation step (e).

The heavy hydrocarbon feedstock 1 is sent via a pipe to the initial hydroconversion section $A_1$ having a high pressure of hydrogen 19. The section $A_1$ is identical to the one described in connection with FIG. 1.

The liquid effluent 3 resulting from the section $A_1$ is separated in the intermediate separation section $B_1$. In the separation section $B_1$, the conditions are generally chosen so as to obtain two liquid fractions, a light fraction 4 and a heavy fraction 5. The section may comprise any separation means known to a person skilled in the art, and preferably includes neither an atmospheric distillation column nor a vacuum distillation column, but a steam- or hydrogen-stripping column, and more preferably consists of a series of flash drums, and even more preferably of a single flash drum.

The heavy liquid fraction 5 leaving the intermediate separation section $B_1$ is then sent via a pipe to the second hydroconversion step $A_2$ having a high pressure of hydrogen 20. This section $A_2$ is in accordance with the description of the initial hydroconversion section $A_1$ from FIG. 1.

The hydroconverted liquid effluent 6 obtained on conclusion of this second hydroconversion step is separated in the first fractionation section C. In this section C, the conditions are chosen so as to obtain at least two liquid fractions, a light cut 11 and a heavy cut 13. The section preferably includes a set of flash drums and an atmospheric distillation column.

The heavy cut 13 is then sent via a pipe to the deasphalter D in order to obtain a DAO 15, which is sent to the second fractionation section E via a pipe, and a residual asphalt 14, which is purged via another pipe.

The DAO fraction is then separated in the second fractionation section E, where the conditions are chosen so as to obtain at least two liquid fractions, a light fraction of the DAO 16 and a heavy fraction of the DAO 17. The section E preferably includes a set of flash drums and a vacuum distillation column.

The heavy fraction of the DAO 17 is then mixed, partly or completely as represented, with the heavy liquid fraction 5 resulting from the intermediate separation section $B_1$ and the mixture is then sent to the second hydroconversion section $A_2$.

Figure 3:
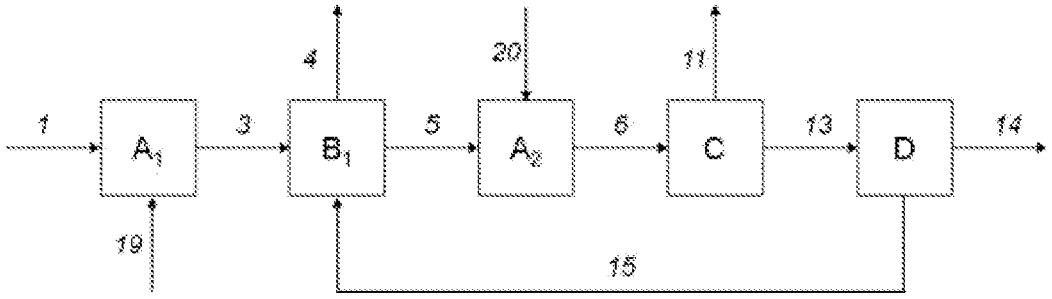
FIG. 3 is a diagram of the process according to a third embodiment in which at least one portion of the DAO is recycled into the separation section intermediate between the two hydroconversion sections.

FIG. 3 illustrates the invention in another embodiment including the recycling of the DAO into the intermediate separation section.

According to this embodiment, the process includes the following successive steps: the initial hydroconversion step ($a_1$), the intermediate separation step ($b_1$), a second hydroconversion step ($a_2$) which is the only additional hydroconversion step, the first fractionation step (c), and the deasphalting step (d). There is no second fractionation step (e).

The heavy hydrocarbon feedstock 1 is sent via a pipe to an initial hydroconversion section $A_1$ having a high pressure of hydrogen 19. The section $A_1$ is identical to the one described in connection with FIG. 1.

The liquid effluent 3 obtained from the section $A_1$ is separated in the intermediate separation section $B_1$ at the same time as the recycled DAO 15 obtained from the deasphalter D. In the intermediate separation section $B_1$, the conditions are chosen so as to obtain two liquid fractions, a light fraction 4 and a heavy fraction 5. The section $B_1$ may include any separation means known to a person skilled in the art, and preferably includes neither an atmospheric distillation column nor a vacuum distillation column, but a steam- or hydrogen-stripping column, and more preferably consists of a series of flash drums, and even more preferably of a single flash drum.

The heavy liquid fraction 5 leaving the intermediate separation section $B_1$ is then sent to the second hydroconversion section $A_2$ having a high pressure of hydrogen 20. This section $A_2$ is in accordance with the description of the initial hydroconversion section $A_1$ from FIG. 1.

The hydroconverted liquid effluent 6 obtained on conclusion of this second hydroconversion step is separated in the first fractionation section C. In this section C, the conditions are chosen so as to obtain at least two liquid fractions, a light cut 11 and a heavy cut 13. The section preferably includes with the aid of a set of flash drums and an atmospheric distillation column.

The heavy cut 13 is then sent via a pipe to the deasphalter D in order to obtain a DAO, which is recycled into the intermediate separation section $B_1$, and a residual asphalt 14, which is purged via another pipe.

The DAO is then mixed, partly or completely as represented, with the liquid effluent 3 resulting from the initial hydroconversion section $A_1$ and the mixture is then sent to the intermediate separation section $B_1$.

Figure 4:
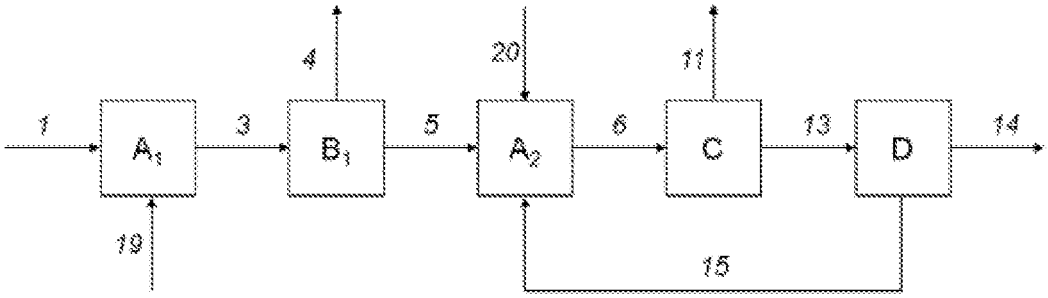
FIG. 4 is a diagram of the process according to a second embodiment in which at least one portion of the DAO is recycled into a second hydroconversion section.

FIG. 4 illustrates the invention in another preferred embodiment including the recycling of the DAO into the inlet of the last hydroconversion step.

According to this embodiment, the process includes the following successive steps: the initial hydroconversion step ($a_1$), the intermediate separation step ($b_1$), a second hydroconversion step ($a_2$) which is the only additional hydroconversion step, the first fractionation step (c), and the deasphalting step (d). There is no second fractionation step (e).

The heavy hydrocarbon feedstock 1 is sent via a pipe to an initial hydroconversion section $A_1$ having a high pressure of hydrogen 19. The section $A_1$ is identical to the one described in connection with FIG. 1.

The liquid effluent 3 resulting from the section $A_1$ is separated in the intermediate separation section $B_1$. In the separation section $B_1$, the conditions are chosen so as to obtain two liquid fractions, a light fraction 4 and a heavy fraction 5. The section may comprise any separation means known to a person skilled in the art, and preferably includes neither an atmospheric distillation column nor a vacuum distillation column, but a steam- or hydrogen-stripping column, and more preferably consists of a series of flash drums, and even more preferably of a single flash drum.

The heavy liquid fraction 5 leaving the intermediate separation section $B_1$ is then sent via a pipe to the second hydroconversion step $A_2$ having a high pressure of hydrogen 20. This section $A_2$ is in accordance with the description of the initial hydroconversion section $A_1$ from FIG. 1.

The hydroconverted liquid effluent 6 obtained on conclusion of this second hydroconversion step is separated in the first fractionation section C. In this section C, the conditions are chosen so as to obtain at least two liquid fractions, a light cut 11 and a heavy cut 13. The section preferably includes a set of flash drums and atmospheric and vacuum distillation columns.

The heavy cut 13 is then sent via a pipe to the deasphalter D in order to obtain a DAO 15, which is recycled via a pipe to the second hydroconversion section $A_2$, and a residual asphalt 14, which is purged via another pipe.

The DAO is then mixed, partly or completely as represented, with the heavy liquid fraction 5 resulting from the intermediate separation section $B_1$ and the mixture is then sent to the second hydroconversion section $A_2$.

Figure 5:
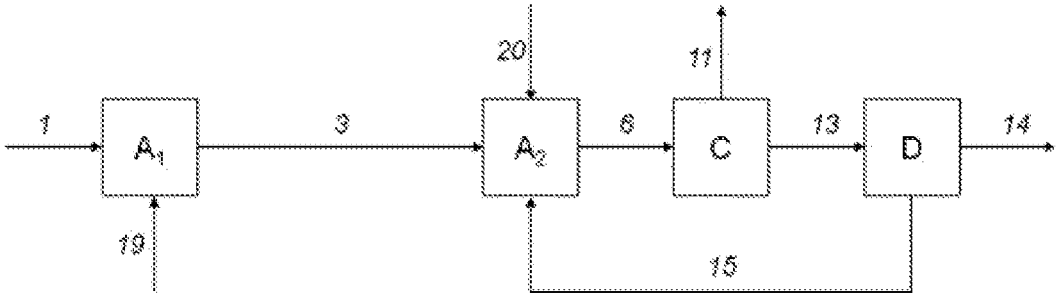
FIG. 5 is a diagram of the process according to a fourth embodiment in which at least one portion of the DAO is recycled into a second hydroconversion section that follows a first hydroconversion section without intermediate separation.

FIG. 5 illustrates the invention in another embodiment not including an intermediate separation step.

According to this embodiment, the process includes the following successive steps: the initial hydroconversion step ($a_1$), a second hydroconversion step ($a_2$) which is the only additional hydroconversion step, the first fractionation step (c), and the deasphalting step (d). There is no second fractionation step (e).

The heavy hydrocarbon feedstock 1 is sent via a pipe to an initial hydroconversion section $A_1$ having a high pressure of hydrogen 19. The section $A_1$ is identical to the one described in connection with FIG. 1.

The liquid effluent 3 resulting from the section $A_1$ is then sent via a pipe to the second hydroconversion step $A_2$ having a high pressure of hydrogen 20. This section $A_2$ is in accordance with the description of the initial hydroconversion section $A_1$ from FIG. 1.

The hydroconverted liquid effluent 6 obtained on conclusion of this second hydroconversion step is separated in the first fractionation section C. In this section C, the conditions are chosen so as to obtain at least two liquid fractions, a light cut 11 and a heavy cut 13. The section preferably includes with the aid of a set of flash drums and atmospheric and vacuum distillation columns.

The heavy cut 13 is then sent via a pipe to the deasphalter D in order to obtain the DAO 15, which is recycled via a pipe into the second hydroconversion section $A_2$, and a residual asphalt 14, which is purged via another pipe.

The DAO 15 is mixed, partly or completely as represented, with the liquid effluent 3 resulting from the initial hydroconversion section $A_1$ and the mixture is sent to the second hydroconversion section $A_2$.

EXAMPLES

The following examples illustrate an exemplary embodiment of the process according to invention, without limiting the scope thereof, and some of the performance qualities thereof, in comparison with processes according to the prior art.

Examples 1, 2 and 6 are not in accordance with the invention. Examples 3, 4, 5 and 7 are in accordance with the invention.

Feedstock

The heavy hydrocarbon feedstock is a vacuum residue (VR) originating from a Urals crude oil, the main characteristics of which are presented in Table 2 below.

TABLE 2

| Feedstock of the first hydroconversion step | | $(a_1)/(a'_1)/(a''_1)$ |
|---|---|---|
| Feedstock | | Urals VR |
| Content of 540° C.+ | % by weight | 84.7 |
| Viscosity at 100° C. | cSt | 880 |
| Density | | 1.0090 |
| Conradson carbon | % by weight | 17.0 |
| $C_7$ Asphaltenes | % by weight | 5.5 |
| Nickel + Vanadium | ppm by weight | 254 |
| Nitrogen | % by weight | 0.615 |
| Sulfur | % by weight | 2.715 |

This VR heavy feedstock is the same fresh feedstock for the different examples.

Example 1: Reference Process without Recycling of the DAO (not in Accordance with the Invention)

This example illustrates a process for hydroconversion of a heavy hydrocarbon feedstock according to the prior art including two successive hydroconversion steps each comprising a reactor with ebullated-bed operation, followed by a deasphalting step without recycling of the DAO.

First Hydroconversion Step

The fresh feedstock of Table 2 is all sent into a first hydroconversion section $A'_1$ in the presence of hydrogen to undergo a first hydroconversion step $(a'_1)$, said section comprising a three-phase reactor containing an NiMo/alumina hydroconversion catalyst with an NiO content of 4% by weight and an $MoO_3$ content of 10% by weight, the percentages being expressed relative to the total mass of the catalyst. The reactor has ebullated-bed operation operating with upflow of liquid and of gas.

The operating conditions applied in the first hydroconversion step are presented in Table 3 below.

TABLE 3

| First hydroconversion step | | $(a'_1)$ |
|---|---|---|
| Reactor HSV | $h^{-1}$ | 0.60 |
| Total P | MPa | 16 |
| Temperature | ° C. | 420 |
| Amount of hydrogen | $Nm^3/m^3$ | 750 |

These operating conditions make it possible to obtain a hydroconverted liquid effluent having a reduced content of Conradson carbon, of metals and of sulfur. The conversion of the 540° C.+ fraction leaving the first hydroconversion step is 42.0% by weight.

Intermediate Separation Step

The hydroconverted liquid effluent obtained from the first hydroconversion step $(a'_1)$ is then sent into an intermediate separation section $B'_1$ composed of a single gas/liquid separator operating at the pressure and temperature of the reactor of the first hydroconversion step. A light fraction and a "heavy" fraction are thus separated. The light fraction is predominately composed of molecules with a boiling point of less than 350° C. and the heavy fraction is predominantly composed of hydrocarbon molecules boiling at a temperature of greater than or equal to 350° C.

The composition of this heavy fraction is presented in Table 4.

TABLE 4

| Feedstock of step | | $(a'_2)$ |
|---|---|---|
| Feedstock | | Heavy fraction obtained from $B'_1$ |
| Density | | 0.9862 |
| Conradson carbon | % by weight | 12.2 |
| $C_7$ Asphaltenes | % by weight | 4.9 |
| Nickel + Vanadium | ppm by weight | 80 |
| Nitrogen | % by weight | 0.60 |
| Sulfur | % by weight | 1.3922 |

Second Hydroconversion Step $(a'_2)$.

The heavy fraction, the composition of which is given in Table 4, is sent into a second hydroconversion section $A'_2$ in the presence of hydrogen to undergo a second hydroconversion step $(a'_2)$.

The second hydroconversion section $A'_2$ comprises a three-phase reactor $A'_2$ containing an NiMo/alumina hydroconversion catalyst with an NiO content of 4% by weight and an $MoO_3$ content of 10% by weight, the percentages being expressed relative to the total mass of the catalyst. The section operates as an ebullated bed operating with upflow of liquid and of gas.

The operating conditions applied in the second hydroconversion step $(a'_2)$ are presented in Table 5 below.

TABLE 5

| Step | | $(a'_2)$ |
|---|---|---|
| Reactor HSV | $h^{-1}$ | 0.54 |
| Total P | MPa | 15.6 |
| Temperature | ° C. | 425 |
| Amount of hydrogen | $Nm^3/m^3$ | 250 |

These operating conditions make it possible to obtain a hydroconverted liquid effluent having a reduced content of Conradson carbon, of metals and of sulfur. The conversion of the 540° C.+ fraction performed during this second hydroconversion step is 38.1% by weight.

First Fractionation Step

The hydroconverted liquid effluent resulting from the hydroconversion step $(a'_2)$ is sent to a fractionation step (c') performed in a fractionation section C' composed of an atmospheric distillation column and a vacuum distillation column, after which a vacuum distillate fraction that boils at a temperature essentially between 350° C. and 500° C. (VD) and an unconverted vacuum residue fraction that boils at a temperature greater than or equal to 500° C. (VR) are recovered, of which the yields relative to the fresh feedstock and product qualities are given in Table 6 below.

TABLE 6

| | | VD | VR |
|---|---|---|---|
| Yield relative to the fresh feedstock | % by weight | 35.2 | 29.0 |
| Density | | 0.9532 | 1.067 |
| Conradson carbon | % by weight | 1.9 | >30 |
| $C_7$ Asphaltenes | % by weight | <0.05 | 15.7 |

TABLE 6-continued

| | | VD | VR |
|---|---|---|---|
| Nickel + Vanadium | ppm by weight | <4 | 151 |
| Nitrogen | % by weight | 0.46 | 0.98 |
| Sulfur | % by weight | 0.7097 | 1.6887 |
| Sediments | % by weight | <0.01 | 0.20 |

Deasphalting Step

The VR resulting from the distillation zone of the fractionation section C' is then advantageously sent to a deasphalting step (d') in a deasphalter D' in which it is treated in an extractor using butane solvent under deasphalting conditions that make it possible to obtain a DAO and a residual asphalt.

The operating conditions applied in the deasphalter are the following:

Total pressure=3 MPa;

Average temperature=95° C.;

Solvent/feedstock ratio=8 v/v.

At the outlet of the deasphalter, a DAO and a residual asphalt are obtained, possessing the characteristics given in Table 7 below.

TABLE 7

| | | DAO | Residual asphalt |
|---|---|---|---|
| Yield | % by weight of the feedstock of the SDA | 69.5 | 30.5 |
| Density | | 0.9939 | 1.282 |
| Conradson carbon | % by weight | 7.84 | >30 |
| $C_7$ Asphaltenes | % by weight | 0.07 | >30 |
| Nickel + Vanadium | ppm by weight | <4 | 490 |
| Nitrogen | % by weight | 0.52 | 2.0 |
| Sulfur | % by weight | 1.049 | 3.146 |

Overall Performance Qualities

With this conventional process, not in accordance with the invention, the overall conversion of the 540° C.+ fraction of the fresh feedstock is 64.0% by weight. The unconverted vacuum residue fraction contains 0.20% by weight of sediments, 150 ppm by weight of metals and a Conradson carbon content of greater than 30% by weight. This cut is thus very difficult to upgrade. The deasphalting of the unconverted vacuum residue makes it possible to extract an upgradable fraction by separating the VR into a DAO fraction (which represents virtually 70% of the VR) and an asphalt fraction. The DAO fraction almost no longer contains any metals, or asphaltenes, and its Conradson carbon content is less than 8%. This DAO cut may thus be sent, partly or totally, into another conversion step such as fixed-bed hydrocracking, fixed-bed hydrotreatment, fluidized-bed catalytic cracking or ebullated-bed hydroconversion.

Example 2: Reference Process with Recycling of the DAO into the Inlet of the First Hydroconversion Step (not in Accordance with the Invention)

In this Example 2, the prior art is illustrated in a process of hydroconversion of a heavy hydrocarbon feedstock including two successive hydroconversion steps each comprising a reactor with ebullated-bed operation, followed by a deasphalting step with recycling of the DAO into the inlet of the last hydroconversion step.

First Hydroconversion Step

The fresh feedstock of Table 2 is first mixed with the DAO obtained from the deasphalting step (d") in a fresh feedstock/DAO volume ratio equal to 75/25. This mixture is then all sent into a first hydroconversion section $A"_1$ in the presence of hydrogen to undergo a first hydroconversion step ($a"_1$). This section $A"_1$ is identical to the one described in Example 1.

The operating conditions applied in this first hydroconversion section $A"_1$ are presented in Table 8 below.

TABLE 8

| Step | | ($a"_1$) |
|---|---|---|
| Reactor HSV | $h^{-1}$ | 0.80 |
| Total P | MPa | 16 |
| Temperature | ° C. | 420 |
| Amount of hydrogen | $Nm^3/m^3$ | 750 |

The increase in the reactor HSV, compared with the HSV during the first hydroconversion step according to Example 1, is due to the recycling of the DAO, the flow rate of fresh feedstock being kept constant. These operating conditions make it possible to obtain a hydroconverted liquid effluent having a reduced content of Conradson carbon, of metals and of sulfur. The conversion per run of the 540° C.+ fraction leaving the first hydroconversion step is 33.4% by weight.

Intermediate Separation Step

The hydroconverted liquid effluent obtained from the first hydroconversion step ($a"_1$) is then sent into an intermediate separation section $B"_1$ composed of a single gas/liquid separator operating at the pressure and temperature of the reactor of the first hydroconversion step. A light fraction and a heavy fraction are thus separated. The light fraction is predominately composed of molecules with a boiling point of less than 350° C. and the "heavy" fraction is predominantly composed of hydrocarbon molecules boiling at a temperature of greater than or equal to 350° C.

The composition of this heavy fraction is presented in Table 9.

TABLE 9

| Feedstock of step | | ($a"_2$) |
|---|---|---|
| Feedstock | | Heavy fraction obtained from $B"_1$ |
| Density | | 0.9747 |
| Conradson carbon | % by weight | 9.3 |
| $C_7$ Asphaltenes | % by weight | 3.6 |
| Nickel + Vanadium | ppm by weight | 70 |
| Nitrogen | % by weight | 0.49 |
| Sulfur | % by weight | 1.1380 |

Second Hydroconversion Step

The heavy fraction, the composition of which is given in Table 9, is all sent into a second hydroconversion section $A"_2$ in the presence of hydrogen to undergo a second hydroconversion step ($a"_2$). This section $A"_2$ is identical to the one described in Example 1.

The operating conditions applied in this second hydroconversion step ($a"_2$) are presented in Table 10 below.

TABLE 10

| Step | | (a"$_2$) |
|---|---|---|
| Reactor HSV | $h^{-1}$ | 0.72 |
| Total P | MPa | 15.6 |
| Temperature | ° C. | 425 |
| Amount of hydrogen | $Nm^3/m^3$ | 250 |

These operating conditions make it possible to obtain a hydroconverted liquid effluent having a reduced content of Conradson carbon, of metals and of sulfur. The conversion per run of the 540° C.+ fraction achieved during this second hydroconversion step is 33.7% by weight.

First Fractionation Step

The hydroconverted liquid effluent from the hydroconversion step (a"$_2$) is sent to a fractionation step (c") performed in a fractionation section C" composed of an atmospheric distillation column and a vacuum distillation column, after which a vacuum distillate fraction that boils at a temperature essentially between 350° C. and 500° C. (VD) and an unconverted vacuum residue fraction that predominantly boils at a temperature greater than or equal to 500° C. (VR) are recovered, of which the yields relative to the fresh feedstock and product qualities are given in Table 11 below.

TABLE 11

| | | VD | VR |
|---|---|---|---|
| Yield relative to the fresh feedstock | % by weight | 36.8 | 34.4 |
| Density | | 0.9383 | 1.039 |
| Conradson carbon | % by weight | 0.8 | 21 |
| $C_7$ Asphaltenes | % by weight | <0.05 | 6.3 |
| Nickel + Vanadium | ppm by weight | <4 | 74 |
| Nitrogen | % by weight | 0.38 | 0.66 |
| Sulfur | % by weight | 0.4292 | 1.0408 |
| Sediments | % by weight | <0.01 | 0.34 |

Deasphalting Step

The VR resulting from the first fractionation section C" is then advantageously sent to a deasphalting step (d") in a deasphalter D", in which it is treated as described in Example 1 (same equipment and same conditions).

At the outlet of the deasphalter, a DAO and a residual asphalt are obtained, having the characteristics given in Table 12 below.

TABLE 12

| | | DAO | Residual asphalt |
|---|---|---|---|
| Yield | % by weight of the feedstock of the SDA | 73.9 | 26.1 |
| Density | | 0.9729 | 1.286 |
| Conradson carbon | % by weight | 4.4 | >30 |
| $C_7$ Asphaltenes | % by weight | <0.05 | 24 |
| Nickel + Vanadium | ppm by weight | <4 | 281 |
| Nitrogen | % by weight | 0.33 | 1.6 |
| Sulfur | % by weight | 0.6689 | 2.094 |

After the deasphalter D, 26% of the DAO produced is purged, while the rest of the DAO is sent upstream of the first hydroconversion step (a"$_1$).

Overall Performance Qualities

With this conventional process including recycling of the DAO into the inlet of the first hydroconversion step, not in accordance with the invention, the conversion per run of the 540° C.+ fraction of the fresh feedstock in the hydroconversion section is 55.9% by weight. The unconverted vacuum residue fraction contains 0.34% by weight of sediments, 74 ppm by weight of metals and a Conradson carbon content of 21% by weight. This cut is thus very difficult to upgrade. The deasphalting of the unconverted vacuum residue makes it possible to extract an upgradable fraction by separating the VR into a DAO fraction (which represents virtually 74% of the VR) and an asphalt fraction. The DAO fraction almost no longer contains any metals, or asphaltenes, and its Conradson carbon content is less than 5%. In this scheme not in accordance with the invention, a substantial fraction of this DAO cut (74%) is recycled into the inlet of the first reactor of the hydroconversion section. By means of the recycling, the overall conversion of the 540° C.+ fraction of the fresh feedstock is 69.7% by weight.

Example 3: Process According to the Invention, which Aims to Reduce the Sediment Content of the Unconverted Vacuum Residue In this example, the process according to the invention is illustrated in an embodiment including two successive hydroconversion steps each comprising a reactor with ebullated-bed operation, followed by a deasphalting step with recycling of the DAO into the inlet of the last hydroconversion reactor.

First Hydroconversion Step

The fresh feedstock of Table 2 is all sent into a first hydroconversion section $A_1$ in the presence of hydrogen to undergo a first hydroconversion step ($a_1$). This section $A_1$ is identical to the one described in Example 1.

The operating conditions applied to this first hydroconversion step ($a_1$) are presented in Table 13 below.

TABLE 13

| Step | | ($a_1$) |
|---|---|---|
| Reactor HSV | $h^{-1}$ | 0.60 |
| Total P | MPa | 16 |
| Temperature | ° C. | 420 |
| Amount of hydrogen | $Nm^3/m^3$ | 750 |

These operating conditions make it possible to obtain a hydroconverted liquid effluent having a reduced content of Conradson carbon, of metals and of sulfur. The conversion of the 540° C.+ fraction achieved during this first hydroconversion step is 42% by weight.

Intermediate Separation Step

The hydroconverted liquid effluent is then sent into an intermediate separation section $B_1$ composed of a single gas/liquid separator operating at the pressure and temperature of the reactor of the first hydroconversion step. A light fraction and a heavy fraction are thus separated. The light fraction is predominately composed of molecules with a boiling point of less than 350° C. and the "heavy" fraction is predominantly composed of hydrocarbon molecules boiling at a temperature of greater than or equal to 350° C.

The composition of this heavy fraction is presented in Table 14.

TABLE 14

| Feedstock | | Heavy fraction obtained from $B_1$ |
|---|---|---|
| Density | | 0.9862 |
| Conradson carbon | % by weight | 12.2 |
| $C_7$ Asphaltenes | % by weight | 4.9 |
| Nickel + Vanadium | ppm by weight | 80 |
| Nitrogen | % by weight | 0.60 |
| Sulfur | % by weight | 1.3922 |

Second Hydroconversion Step

In this example of the process according to the invention, the heavy effluent obtained from the intermediate separation section $B_1$ is all mixed with the DAO obtained from the deasphalting step (d) in a heavy effluent/DAO volume ratio of 75/25. The composition of this feedstock is presented in Table 15.

TABLE 15

| Feedstock of step | | ($a_2$) |
|---|---|---|
| Density | | 0.9854 |
| Conradson carbon | % by weight | 10.4 |
| $C_7$ Asphaltenes | % by weight | 3.7 |
| Nickel + Vanadium | ppm by weight | 60 |
| Nitrogen | % by weight | 0.54 |
| Sulfur | % by weight | 1.2186 |

In this example according to the invention, this mixture is all sent to a second hydroconversion section $A_2$ in the presence of hydrogen to undergo a second hydroconversion step ($a_2$). Said section $A_2$ is identical to the one described in Example 1.

The operating conditions applied in the hydroconversion step ($a_2$) are presented in Table 16 below.

TABLE 16

| Step | | ($a_2$) |
|---|---|---|
| Reactor HSV | $h^{-1}$ | 0.72 |
| Total P | MPa | 15.6 |
| Temperature | ° C. | 425 |
| Amount of hydrogen | $Nm^3/m^3$ | 250 |

These operating conditions make it possible to obtain a hydroconverted liquid effluent having a reduced content of Conradson carbon, of metals and of sulfur. The conversion per run of the 540° C.+ fraction achieved during this second hydroconversion step is 33.0% by weight.

First Fractionation Section

The hydroconverted liquid effluent resulting from the hydroconversion step ($a_2$) is sent to a fractionation step (c) performed in a fractionation section C composed of an atmospheric distillation column and a vacuum distillation column, after which a vacuum distillate fraction that boils at a temperature essentially between 350° C. and 500° C. (VD) and an unconverted vacuum residue fraction that boils at a temperature greater than or equal to 500° C. (VR) are recovered. The yields relative to the fresh feedstock and product qualities are given of this first fractionation section are indicated in Table 17 below.

TABLE 17

| | | VD | VR |
|---|---|---|---|
| Yield relative to the fresh feedstock | % by weight | 36.4 | 33.9 |
| Density | | 0.9483 | 1.048 |
| Conradson carbon | % by weight | 0.9 | 24 |
| $C_7$ Asphaltenes | % by weight | <0.05 | 7.2 |
| Nickel + Vanadium | ppm by weight | <4 | 63 |
| Nitrogen | % by weight | 0.44 | 0.75 |
| Sulfur | % by weight | 0.6113 | 1.1141 |
| Sediments | % by weight | <0.01 | 0.07 |

By comparing with Example 1, a higher degree of hydrotreatment with a lower density, and smaller contents of sulfur, nitrogen, metals, asphaltenes and Conradson carbon are observed. Furthermore, the VR contains a smaller amount of sediments and is thus more stable, notably by virtue of the presence of heavy aromatics of the DAO recycled upstream of the second hydroconversion step.

By comparing with Example 2, it is noted that the degree of hydrotreatment is slightly lower, but that the VR contains a much smaller amount of sediments. This cut is thus more stable, notably by virtue of the presence of heavy aromatics of the DAO cut recycled upstream of the second hydroconversion step. In Example 2, the DAO is recycled upstream of the first hydroconversion step and the heavy aromatics are further hydrogenated in comparison with the process according to the invention.

Deasphalting Step

The VR resulting from the first fractionation step is then advantageously sent to a deasphalting step (d) in a deasphalter, in which it is treated as described in Example 1 (same equipment and same conditions).

At the outlet of the deasphalter, a DAO and a residual asphalt are obtained, having the characteristics given in Table 18 below.

TABLE 18

| | | DAO | Residual asphalt |
|---|---|---|---|
| Yield | % by weight of the feedstock of the SDA | 73.5 | 26.5 |
| Density | | 0.9832 | 1.282 |
| Conradson carbon | % by weight | 4.8 | >30 |
| $C_7$ Asphaltenes | % by weight | <0.05 | 27 |
| Nickel + Vanadium | ppm by weight | <4 | 235 |
| Nitrogen | % by weight | 0.37 | 1.8 |
| Sulfur | % by weight | 0.6976 | 2.269 |

After the deasphalter D, 26% of the DAO produced is purged, while the rest of the DAO is sent upstream of the second hydroconversion step.

Overall Performance Qualities

According to the process of the invention illustrated in this example, including recycling of the DAO into the last hydroconversion step, the conversion per run of the 540° C.+ fraction of the fresh feedstock from the hydroconversion section is 61.5% by weight. The unconverted vacuum residue fraction contains 0.07% by weight of sediments, 63 ppm by weight of metals and a Conradson carbon content of 24% by weight. This cut is thus very difficult to upgrade. The deasphalting of the unconverted vacuum residue makes it possible to extract an upgradable fraction by separating the VR into a DAO fraction (which represents virtually 74% of the VR) and an asphalt fraction. The DAO fraction almost no longer contains any metals, or asphaltenes, and its Conradson carbon content is less than 5%. In this scheme according to the invention, a substantial fraction of this DAO cut (74%) is recycled into the inlet of the last reactor of the hydroconversion section. By means of the recycling, the overall conversion of the 540° C.+ fraction of the fresh feedstock is 69.5% by weight.

It is thus noted that, relative to Example 1, the conversion is higher (5.5 conversion points higher) and that the VR which leaves the vacuum distillation column in the first fractionation step is more stable (0.07% by weight instead of 0.20% by weight) since it contains a smaller amount of sediments, thus limiting the fouling of the columns of the first fractionation section. Relative to Example 2, the overall conversion is identical, but the residual VR contains five times less of sediments (0.07% by weight instead of 0.34% by weight). As a result, the fouling of the columns of the first fractionation section is greatly reduced, allowing a longer operation before stoppage for cleaning thereof.

Example 4: Process According to the Invention, Directed Toward Increasing the Overall Conversion of the 540° C.+ Fraction In this example, the process according to the invention is illustrated in an embodiment including two successive hydroconversion steps each comprising a reactor with ebullated-bed operation, followed by a deasphalting step with recycling of the DAO into the inlet of the last hydroconversion reactor. As the sediment content is reduced in the process according to the invention said process will be operated under more stringent conditions in order to increase the overall conversion of the process.

First Hydroconversion Step

The fresh feedstock of Table 2 is all sent into a first hydroconversion section $A_1$ in the presence of hydrogen to undergo a first hydroconversion step ($a_1$). This section $A_1$ is identical to the one described in Example 1.

The operating conditions applied to this first hydroconversion step ($a_1$) are presented in Table 19 below.

TABLE 19

| Step | | ($a_1$) |
|---|---|---|
| Reactor HSV | $h^{-1}$ | 0.60 |
| Total P | MPa | 16 |
| Temperature | ° C. | 420 |
| Amount of hydrogen | $Nm^3/m^3$ | 750 |

These operating conditions make it possible to obtain a hydroconverted liquid effluent having a reduced content of Conradson carbon, of metals and of sulfur. The conversion of the 540° C.+ fraction achieved during this first hydroconversion step is 42% by weight.

Intermediate Separation Step

The hydroconverted liquid effluent is then sent into an intermediate separation section $B_1$ composed of a single gas/liquid separator operating at the pressure and temperature of the reactor of the first hydroconversion step. A light fraction and a heavy fraction are thus separated. The light fraction is predominately composed of molecules with a boiling point of less than 350° C. and the "heavy" fraction is predominantly composed of hydrocarbon molecules boiling at a temperature of greater than or equal to 350° C.

The composition of this heavy fraction is presented in Table 20.

TABLE 20

| Feedstock | | Heavy fraction obtained from $B_1$ |
|---|---|---|
| Density | | 0.9862 |
| Conradson carbon | % by weight | 12.2 |
| $C_7$ Asphaltenes | % by weight | 4.9 |
| Nickel + Vanadium | ppm by weight | 80 |
| Nitrogen | % by weight | 0.60 |
| Sulfur | % by weight | 1.3922 |

Second Hydroconversion Step

In this example of the process according to the invention, the heavy effluent obtained from the intermediate separation section $B_1$ is all mixed with the DAO obtained from the deasphalting step (d) in a heavy effluent/DAO volume ratio of 75/25. The composition of this feedstock is presented in Table 21.

TABLE 21

| Feedstock of step | | ($a_2$) |
|---|---|---|
| Density | | 0.9865 |
| Conradson carbon | % by weight | 10.6 |
| $C_7$ Asphaltenes | % by weight | 3.7 |
| Nickel + Vanadium | ppm by weight | 60 |
| Nitrogen | % by weight | 0.55 |
| Sulfur | % by weight | 1.2324 |

In this example according to the invention, this mixture is all sent to a second hydroconversion section $A_2$ in the presence of hydrogen to undergo a second hydroconversion step ($a_2$). Said section $A_2$ is identical to the one described in Example 1.

The operating conditions applied in the hydroconversion step ($a_2$) are presented in Table 22 below. Relative to the other examples, the reaction temperature was increased by 5° C.

TABLE 22

| Step | | ($a_2$) |
|---|---|---|
| Reactor HSV | $h^{-1}$ | 0.72 |
| Total P | MPa | 15.6 |
| Temperature | ° C. | 430 |
| Amount of hydrogen | $Nm^3/m^3$ | 250 |

These operating conditions make it possible to obtain a hydroconverted liquid effluent having a reduced content of Conradson carbon, of metals and of sulfur. The conversion per run of the 540° C.+ fraction achieved during this second hydroconversion step is 38.4% by weight.

First Fractionation Section

The hydroconverted liquid effluent resulting from the hydroconversion step ($a_2$) is sent to a fractionation step (c) performed in a fractionation section C composed of an atmospheric distillation column and a vacuum distillation column, after which a vacuum distillate fraction that boils at a temperature essentially between 350° C. and 500° C. (VD) and an unconverted vacuum residue fraction that boils at a temperature greater than or equal to 500° C. (VR) are recovered. The yields relative to the fresh feedstock and product qualities are given of this first fractionation section are indicated in Table 23 below.

TABLE 23

| | | VD | VR |
|---|---|---|---|
| Yield relative to the fresh feedstock | % by weight | 34.9 | 29.1 |
| Density | | 0.9496 | 1.055 |
| Conradson carbon | % by weight | 0.8 | 27 |
| $C_7$ Asphaltenes | % by weight | <0.05 | 9.7 |
| Nickel + Vanadium | ppm by weight | <4 | 61 |
| Nitrogen | % by weight | 0.45 | 0.80 |
| Sulfur | % by weight | 0.6208 | 1.1862 |
| Sediments | % by weight | <0.01 | 0.19 |

By comparing with Example 1, a higher degree of hydrotreatment with a lower density, and smaller contents of sulfur, nitrogen, metals, asphaltenes and Conradson carbon are observed. Despite the higher severity, the VR contains the same content of sediments and thus remains stable, notably by virtue of the presence of heavy aromatics of the DAO recycled upstream of the second hydroconversion step.

By comparing with Example 2, it is noted that the degree of hydrotreatment is very similar, but that the VR contains a smaller amount of sediments. This cut is thus more stable, notably by virtue of the presence of heavy aromatics of the DAO cut recycled upstream of the second hydroconversion step. In Example 2, the DAO is recycled upstream of the first hydroconversion step and the heavy aromatics are further hydrogenated in comparison with the process according to the invention.

Deasphalting Step

The VR resulting from the first fractionation step is then advantageously sent to a deasphalting step (d) in a deasphalter, in which it is treated as described in Example 1 (same equipment and same conditions).

At the outlet of the deasphalter, a DAO and a residual asphalt are obtained, having the characteristics given in Table 24 below.

TABLE 24

| | | DAO | Residual asphalt |
|---|---|---|---|
| Yield | % by weight of the feedstock of the SDA | 72.6 | 27.4 |
| Density | | 0.9873 | 1.289 |
| Conradson carbon | % by weight | 5.6 | >30 |
| $C_7$ Asphaltenes | % by weight | <0.05 | >30 |
| Nickel + Vanadium | ppm by weight | <4 | 220 |
| Nitrogen | % by weight | 0.39 | 1.9 |
| Sulfur | % by weight | 0.7529 | 2.334 |

After the deasphalter D, 17% of the DAO produced is purged, while the rest of the DAO is sent upstream of the last hydroconversion step.

Overall Performance Qualities

According to the process of the invention illustrated in this example, including recycling of the DAO into the last hydroconversion step performed under more stringent conditions, a conversion per run of the 540° C.+ fraction of the fresh feedstock of 64.6% by weight is achieved in the hydroconversion section for identical operating conditions. The unconverted fraction, the vacuum residue, contains 0.19% by weight of sediments, 61 ppm by weight of metals and a Conradson carbon content of 27% by weight. This cut is thus very difficult to upgrade. The deasphalting of the unconverted vacuum residue makes it possible to extract an upgradable fraction by separating the VR into a DAO fraction (which represents virtually 73% of the VR) and an asphalt fraction. The DAO fraction almost no longer contains any metals, or asphaltenes, and its Conradson carbon content is less than 6%. In this scheme according to the invention, a substantial fraction of this DAO cut (83%) is recycled into the inlet of the last reactor of the hydroconversion section. By means of the recycling, the overall conversion of the 540° C.+ fraction of the fresh feedstock is 73.9% by weight.

It is thus noted that, relative to Example 1, the conversion is much higher (+10 conversion points) but that the VR which leaves the vacuum distillation column in the first fractionation step remains stable, since it contains approximately the same content of sediments (0.19% by weight instead of 0.20% by weight). Relative to Example 2, the conversion is higher (+4 conversion points), but the residual VR nevertheless contains a much smaller amount of sediments (0.19% by weight instead of 0.34% by weight) and thus remains stable under these more stringent conditions. As a result, in the scheme according to the invention, the fouling of the columns of the first fractionation section is greatly reduced relative to scheme 2 not in accordance with the invention, allowing a longer operation before stoppage for cleaning thereof.

Example 5: Process According to the Invention, Directed Toward Recycling the DAO Cut to the Point of Extinction In this example, the process according to the invention is illustrated in an embodiment including two successive hydroconversion steps each comprising a reactor with ebullated-bed operation, followed by a deasphalting step with recycling of the DAO into the inlet of the last hydroconversion reactor. The DAO cut will be recycled to the point of extinction in order to increase the overall conversion of the process.

First Hydroconversion Step

The fresh feedstock of Table 2 is all sent into a first hydroconversion section $A_1$ in the presence of hydrogen to undergo a first hydroconversion step ($a_1$). This section $A_1$ is identical to the one described in Example 1.

The operating conditions applied to this first hydroconversion step ($a_1$) are presented in Table 25 below.

TABLE 25

| Step | | ($a_1$) |
|---|---|---|
| Reactor HSV | $h^{-1}$ | 0.60 |
| Total P | MPa | 16 |
| Temperature | ° C. | 420 |
| Amount of hydrogen | $Nm^3/m^3$ | 750 |

These operating conditions make it possible to obtain a hydroconverted liquid effluent having a reduced content of Conradson carbon, of metals and of sulfur. The conversion of the 540° C.+ fraction achieved during this first hydroconversion step is 42% by weight.

Intermediate Separation Step

The hydroconverted liquid effluent is then sent into an intermediate separation section $B_1$ composed of a single gas/liquid separator operating at the pressure and temperature of the reactor of the first hydroconversion step. A light fraction and a heavy fraction are thus separated. The light fraction is predominately composed of molecules with a boiling point of less than 350° C. and the "heavy" fraction is predominantly composed of hydrocarbon molecules boiling at a temperature of greater than or equal to 350° C.

The composition of this heavy fraction is presented in Table 26.

TABLE 26

| Feedstock | | Heavy fraction obtained from $B_1$ |
|---|---|---|
| Density | | 0.9862 |
| Conradson carbon | % by weight | 12.2 |
| $C_7$ Asphaltenes | % by weight | 4.9 |
| Nickel + Vanadium | ppm by weight | 80 |
| Nitrogen | % by weight | 0.60 |
| Sulfur | % by weight | 1.3922 |

Second Hydroconversion Step

In this example of the process according to the invention, the heavy effluent obtained from the intermediate separation section $B_1$ is all mixed with all of he DAO obtained from the deasphalting step (d). The composition of this feedstock is presented in Table 27.

TABLE 27

| Feedstock of step | | ($a_2$) |
|---|---|---|
| Density | | 0.9857 |
| Conradson carbon | % by weight | 9.8 |
| $C_7$ Asphaltenes | % by weight | 3.2 |
| Nickel + Vanadium | ppm by weight | 52 |
| Nitrogen | % by weight | 0.52 |
| Sulfur | % by weight | 1.1591 |

In this example according to the invention, this mixture is all sent to a second hydroconversion section $A_2$ in the presence of hydrogen to undergo a second hydroconversion step ($a_2$). Said section $A_2$ is identical to the one described in Example 1.

The operating conditions applied in the hydroconversion step ($a_2$) are presented in Table 28 below. As the recycling of the DAO cut is total, the $HSV_{reactor}$ is higher.

TABLE 28

| Step | | ($a_2$) |
|---|---|---|
| Reactor HSV | $h^{-1}$ | 0.81 |
| Total P | MPa | 15.6 |
| Temperature | ° C. | 430 |
| Amount of hydrogen | $Nm^3/m^3$ | 250 |

These operating conditions make it possible to obtain a hydroconverted liquid effluent having a reduced content of Conradson carbon, of metals and of sulfur. The conversion per run of the 540° C.+ fraction achieved during this second hydroconversion step is 36.2% by weight.

First Fractionation Section

The hydroconverted liquid effluent resulting from the hydroconversion step ($a_2$) is sent to a fractionation step (c) performed in a fractionation section C composed of an atmospheric distillation column and a vacuum distillation column, after which a vacuum distillate fraction that boils at a temperature essentially between 350° C. and 500° C. (VD) and an unconverted vacuum residue fraction that boils at a temperature greater than or equal to 500° C. (VR) are recovered. The yields relative to the fresh feedstock and product qualities are given of this first fractionation section are indicated in Table 29 below.

TABLE 29

| | | VD | VR |
|---|---|---|---|
| Yield relative to the fresh feedstock | % by weight | 35.6 | 31.8 |
| Density | | 0.9492 | 1.051 |
| Conradson carbon | % by weight | 0.8 | 25 |
| $C_7$ Asphaltenes | % by weight | <0.05 | 8.3 |
| Nickel + Vanadium | ppm by weight | <4 | 66 |
| Nitrogen | % by weight | 0.43 | 0.77 |
| Sulfur | % by weight | 0.5787 | 1.1506 |
| Sediments | % by weight | <0.01 | 0.25 |

By comparing with Example 1, a higher degree of hydrotreatment with a lower density, and smaller contents of sulfur, nitrogen, metals, asphaltenes and Conradson carbon are observed. Despite the higher severity, the VR contains a similar content of sediments (0.25% by weight relative to 0.20% by weight in Example 1) and thus remains stable, notably by virtue of the presence of heavy aromatics of the DAO recycled upstream of the second hydroconversion step.

By comparing with Example 2, it is noted that the degree of hydrotreatment is very similar, but that the VR contains a smaller amount of sediments. This cut is thus more stable, notably by virtue of the presence of heavy aromatics of the DAO cut recycled upstream of the second hydroconversion step. In Example 2, the DAO is recycled upstream of the first hydroconversion step and the heavy aromatics are further hydrogenated in comparison with the process according to the invention.

Deasphalting Step

The VR resulting from the first fractionation step is then advantageously sent to a deasphalting step (d) in a deasphalter, in which it is treated as described in Example 1 (same equipment and same conditions).

At the outlet of the deasphalter, a DAO and a residual asphalt are obtained, having the characteristics given in Table 30 below.

TABLE 30

| | | DAO | Residual asphalt |
|---|---|---|---|
| Yield | % by weight of the feedstock of the SDA | 73.3 | 26.7 |
| Density | | 0.9851 | 1.287 |
| Conradson carbon | % by weight | 5.2 | >30 |
| $C_7$ Asphaltenes | % by weight | <0.05 | >30 |
| Nickel + Vanadium | ppm by weight | <4 | 244 |

TABLE 30-continued

| | | DAO | Residual asphalt |
|---|---|---|---|
| Nitrogen | % by weight | 0.38 | 1.8 |
| Sulfur | % by weight | 0.7249 | 2.319 |

After the deasphalter D, the DAO cut is all sent upstream of the last hydroconversion step.

Overall Performance Qualities

According to the process of the invention illustrated in this example, including recycling of the DAO into the last hydroconversion step performed under more stringent conditions, a conversion per run of the 540° C.+ fraction of the fresh feedstock of 64.6% by weight is achieved in the hydroconversion section for identical operating conditions. The unconverted fraction, the vacuum residue, contains 0.25% by weight of sediments, 66 ppm by weight of metals and a Conradson carbon content of 25% by weight. This cut is thus very difficult to upgrade. The deasphalting of the unconverted vacuum residue makes it possible to extract an upgradable fraction by separating the VR into a DAO fraction (which represents 73.3% of the VR) and an asphalt fraction. The DAO fraction almost no longer contains any metals, or asphaltenes, and its Conradson carbon content is only 5.2% by weight. In this scheme according to the invention, all of this DAO cut is recycled into the inlet of the last reactor of the hydroconversion section. By means of the recycling to extinction of the DAO cut, the overall conversion of the 540° C.+ fraction of the fresh feedstock is 76.1% by weight.

It is thus noted that, relative to Example 1, the conversion is much higher (+12 conversion points) but that the VR which leaves the vacuum distillation column in the first fractionation step remains stable, since it contains approximately the same content of sediments (0.25% by weight instead of 0.20% by weight). Relative to Example 2, the conversion is higher (6 conversion points more), but the residual VR contains a smaller amount of sediments (0.25% by weight instead of 0.34% by weight) and thus remains relatively stable under these more stringent conditions. As a result, in the scheme according to the invention, the fouling of the columns of the first fractionation section is greatly reduced relative to scheme 2 not in accordance with the invention, allowing a longer operation before stoppage for cleaning thereof.

Example 6: Process According to the Invention, which Aims to Reduce the Sediment Content of the Unconverted Vacuum Residue In this example, the process according to the invention is illustrated in an embodiment including two successive hydroconversion steps each comprising a reactor with ebullated-bed operation, followed by a deasphalting step and a fractionation step, with recycling of the heavy DAO into the inlet of the last hydroconversion reactor and conversion of the light DAO in an FCC unit.

First Hydroconversion Step

The fresh feedstock of Table 2 is all sent into a first hydroconversion section $A_1$ in the presence of hydrogen to undergo a first hydroconversion step ($a_1$). This section $A_1$ is identical to the one described in Example 1.

The operating conditions applied to this first hydroconversion step ($a_1$) are presented in Table 31 below.

TABLE 31

| Step | | ($a_1$) |
|---|---|---|
| Reactor HSV | $h^{-1}$ | 0.60 |
| Total P | MPa | 16 |
| Temperature | ° C. | 420 |
| Amount of hydrogen | $Nm^3/m^3$ | 750 |

These operating conditions make it possible to obtain a hydroconverted liquid effluent having a reduced content of Conradson carbon, of metals and of sulfur. The conversion of the 540° C.+ fraction achieved during this first hydroconversion step is 42% by weight.

Intermediate Separation Step

The hydroconverted liquid effluent is then sent into an intermediate separation section $B_1$ composed of a single gas/liquid separator operating at the pressure and temperature of the reactor of the first hydroconversion step. A light fraction and a heavy fraction are thus separated. The light fraction is predominately composed of molecules with a boiling point of less than 350° C. and the "heavy" fraction is predominantly composed of hydrocarbon molecules boiling at a temperature of greater than or equal to 350° C.

The composition of this heavy fraction is presented in Table 32.

TABLE 32

| Feedstock | | Heavy fraction obtained from $B_1$ |
|---|---|---|
| Density | | 0.9862 |
| Conradson carbon | % by weight | 12.2 |
| $C_7$ Asphaltenes | % by weight | 4.9 |
| Nickel + Vanadium | ppm by weight | 80 |
| Nitrogen | % by weight | 0.60 |
| Sulfur | % by weight | 1.3922 |

Second Hydroconversion Step

In this example of the process according to the invention, the heavy effluent obtained from the intermediate separation section $B_1$ is all mixed with the heavy DAO obtained from the second fractionation section (e) in a heavy effluent/DAO volume ratio of 75/25. The composition of this feedstock is presented in Table 33.

TABLE 33

| Feedstock of step | | ($a_2$) |
|---|---|---|
| Density | | 1.0005 |
| Conradson carbon | % by weight | 12.2 |
| $C_7$ Asphaltenes | % by weight | 3.6 |
| Nickel + Vanadium | ppm by weight | 59 |
| Nitrogen | % by weight | 0.57 |
| Sulfur | % by weight | 1.2706 |

In this example according to the invention, this mixture is all sent to a second hydroconversion section $A_2$ in the presence of hydrogen to undergo a second hydroconversion step ($a_2$). Said section $A_2$ is identical to the one described in Example 1.

The operating conditions applied in the hydroconversion step ($a_2$) are presented in Table 34 below.

TABLE 34

| Step | | ($a_2$) |
|---|---|---|
| Reactor HSV | $h^{-1}$ | 0.72 |
| Total P | MPa | 15.6 |
| Temperature | ° C. | 425 |
| Amount of hydrogen | $Nm^3/m^3$ | 250 |

These operating conditions make it possible to obtain a hydroconverted liquid effluent having a reduced content of Conradson carbon, of metals and of sulfur. The conversion per run of the 540° C.+ fraction achieved during this second hydroconversion step is 32.0% by weight.

First Fractionation Section

The hydroconverted liquid effluent resulting from the hydroconversion step ($a_2$) is sent to a fractionation step (c) performed in a fractionation section C composed of an atmospheric distillation column and a vacuum distillation column, after which a vacuum distillate fraction that boils at a temperature essentially between 350° C. and 500° C. (VD) and an unconverted vacuum residue fraction that boils at a temperature greater than or equal to 500° C. (VR) are recovered. The yields relative to the fresh feedstock and product qualities are given of this first fractionation section are indicated in Table 35 below.

TABLE 35

| | | VD | VR |
|---|---|---|---|
| Yield relative to the fresh feedstock | % by weight | 31.5 | 39.2 |
| Density | | 0.9543 | 1.058 |
| Conradson carbon | % by weight | 1.0 | 28 |
| $C_7$ Asphaltenes | % by weight | <0.05 | 7.5 |
| Nickel + Vanadium | ppm by weight | <4 | 67 |
| Nitrogen | % by weight | 0.46 | 0.78 |
| Sulfur | % by weight | 0.6425 | 1.1496 |
| Sediments | % by weight | <0.01 | 0.12 |

By comparing with Example 1, a higher degree of hydrotreatment with a lower density, and smaller contents of sulfur, nitrogen, metals, asphaltenes and Conradson carbon are observed. Furthermore, the VR contains a smaller amount of sediments and is thus more stable, notably by virtue of the presence of heavy aromatics of the DAO recycled upstream of the second hydroconversion step.

By comparing with Example 2, it is noted that the degree of hydrotreatment is lower, but that the VR contains a much smaller amount of sediments. This cut is thus more stable, notably by virtue of the presence of heavy aromatics of the heavy DAO cut recycled upstream of the second hydroconversion step. In Example 2, the DAO is all recycled upstream of the first hydroconversion step and the heavy aromatics are further hydrogenated in comparison with the process according to the invention.

Deasphalting Step

The VR resulting from the first fractionation step is then advantageously sent to a deasphalting step (d) in a deasphalter, in which it is treated as described in Example 1 (same equipment and same conditions).

At the outlet of the deasphalter, a DAO and a residual asphalt are obtained, having the characteristics given in Table 36 below.

TABLE 36

| | | DAO | Residual asphalt |
|---|---|---|---|
| Yield | % by weight of the feedstock of the SDA | 71.9 | 28.1 |
| Density | | 0.9897 | 1.285 |
| Conradson carbon | % by weight | 5.7 | >30 |
| $C_7$ Asphaltenes | % by weight | <0.05 | 27 |
| Nickel + Vanadium | ppm by weight | <4 | 236 |
| Nitrogen | % by weight | 0.39 | 1.8 |
| Sulfur | % by weight | 0.7381 | 2.203 |

Second Fractionation Section

After the deasphalter D, the DAO cut produced is sent to a second fractionation step (e) performed in a fractionation section E composed of a series of flash drums, an atmospheric distillation column and a vacuum distillation column, after which a light DAO cut (DAO−) that boils at a temperature essentially below 580° C. and a heavy DAO cut (DAO+) that boils predominantly at a temperature greater than or equal to 580° C. are recovered. The characteristics of the light DAO cut and of the heavy DAO cut are given in Table 37 below.

TABLE 37

| | | DAO− | DAO+ |
|---|---|---|---|
| Distillation yield | % by weight | 54.0 | 46.0 |
| Density | | 0.9374 | 1.059 |
| Conradson carbon | % by weight | 0.28 | 12.1 |
| $C_7$ Asphaltenes | % by weight | <0.05 | not measured |
| Nickel + Vanadium | ppm by weight | <4 | <4 |
| Molybdenum | ppm by weight | <1 | not measured |
| Nitrogen | % by weight | 0.31 | 0.48 |
| Sulfur | % by weight | 0.5605 | 0.9469 |

The heavy DAO cut (DAO+) resulting from the fractionation step (e) is sent in its entirety to the second hydroconversion step, while the light DAO fraction (DAO−) is sent to an FCC catalytic cracking unit for additional conversion.

Step of Conversion in an FCC Unit

The light DAO cut (DAO−) resulting from the second fractionation section (e) performed in the fractionation section E is then sent to a fluid catalytic cracking unit, also referred to as an FCC unit. This conversion unit makes it possible to transform the DAO fraction, which is a 540° C.+ cut, into lighter fractions. This therefore makes it possible to increase the overall conversion of the starting feedstock. However, the liquid fraction resulting from the FCC unit still contains an unconverted 540° C.+ fraction, the yield of which is only 0.4% by weight relative to the feedstock of the FCC, as indicated in Table 38.

TABLE 38

| Unit | | FCC |
|---|---|---|
| Yield Gasoline (C5 – 220° C.) | % by weight | 47.3 |
| Yield Gas Oil (220 – 360° C.) | % by weight | 13.1 |
| Yield Vacuum Distillate | % by | 9.8 |

TABLE 38-continued

| Unit | | FCC |
|---|---|---|
| (360 – 540° C.) | weight | |
| Yield Vacuum Residue (540° C.+) | % by weight | 0.4 |

Overall Performance Qualities

According to the process of the invention illustrated in this example, including recycling of the DAO into the last hydroconversion step, the conversion per run of the 540° C.+ fraction of the fresh feedstock from the hydroconversion section is 60.9% by weight. The unconverted vacuum residue fraction contains 0.12% by weight of sediments, 67 ppm by weight of metals and a Conradson carbon content of 28% by weight. This cut is thus very difficult to upgrade. The deasphalting of the unconverted vacuum residue makes it possible to extract an upgradable fraction by separating the VR into a DAO fraction (which represents about 72% of the VR) and an asphalt fraction. The DAO fraction almost no longer contains any metals, or asphaltenes, and its Conradson carbon content is less than 6%. In this scheme according to the invention, the DAO cut is sent to a second fractionation section in order to produce a light DAO cut, which is sent to an FCC catalytic cracking unit for additional conversion, and a heavy DAO cut, which is all recycled into the inlet of the last hydroconversion step. By means of the recycling of the heavy DAO cut, the overall conversion of the 540° C.+ fraction of the fresh feedstock is 73.4% by weight in the hydrotreatment section. By means of the conversion of the light DAO in the FCC unit, and additional conversion of 4.1% by weight is obtained, leading to an overall conversion for the scheme according to the invention of 77.5% by weight for the 540° C.+ fraction of the fresh feedstock.

It is thus noted that, relative to Example 1, the conversion is much higher (+13.5 conversion points), while at the same time maintaining a stable VR which leaves the vacuum distillation column in the first fractionation step since it contains a smaller amount of sediments (0.12% by weight instead of 0.20% by weight), thus limiting the fouling of the columns of the first fractionation section. Relative to Example 2, the conversion is not only higher (nearly 8 conversion points more), but the residual VR contains a much smaller amount of sediments (0.12% by weight instead of 0.34% by weight) and thus remains stable under these more stringent conditions. As a result, in the scheme according to the invention, the fouling of the columns of the first fractionation section is greatly reduced relative to the scheme of Example 2 not in accordance with the invention, allowing a longer operation before stoppage for cleaning thereof. Compared with Example 3, the use of an FCC unit for the conversion of the light DAO cut makes it possible to produce more gasoline and less gas oil.

Example 7: Process According to the Invention, Directed Toward Increasing the Overall Conversion of the 540° C.+ Fraction In this example, the process according to the invention is illustrated in an embodiment including two successive hydroconversion steps each comprising a reactor with ebullated-bed operation, followed by a deasphalting step and a fractionation step, with recycling of the heavy DAO into the inlet of the last hydroconversion reactor and conversion of the light DAO in an FCC unit. As the sediment content is reduced in the process according to the invention said process will be operated under more stringent conditions in order to increase the overall conversion of the process.

First Hydroconversion Step

The fresh feedstock of Table 2 is all sent into a first hydroconversion section $A_1$ in the presence of hydrogen to undergo a first hydroconversion step ($a_1$). This section $A_1$ is identical to the one described in Example 1.

The operating conditions applied to this first hydroconversion step ($a_1$) are presented in Table 39 below.

TABLE 39

| Step | | ($a_1$) |
|---|---|---|
| Reactor HSV | $h^{-1}$ | 0.60 |
| Total P | MPa | 16 |
| Temperature | ° C. | 420 |
| Amount of hydrogen | $Nm^3/m^3$ | 750 |

These operating conditions make it possible to obtain a hydroconverted liquid effluent having a reduced content of Conradson carbon, of metals and of sulfur. The conversion of the 540° C.+ fraction achieved during this first hydroconversion step is 42% by weight.

Intermediate Separation Step

The hydroconverted liquid effluent is then sent into an intermediate separation section $B_1$ composed of a single gas/liquid separator operating at the pressure and temperature of the reactor of the first hydroconversion step. A light fraction and a heavy fraction are thus separated. The light fraction is predominately composed of molecules with a boiling point of less than 350° C. and the "heavy" fraction is predominantly composed of hydrocarbon molecules boiling at a temperature of greater than or equal to 350° C.

The composition of this heavy fraction is presented in Table 40.

TABLE 40

| Feedstock | | Heavy fraction obtained from $B_1$ |
|---|---|---|
| Density | | 0.9862 |
| Conradson carbon | % by weight | 12.2 |
| $C_7$ Asphaltenes | % by weight | 4.9 |
| Nickel + Vanadium | ppm by weight | 80 |
| Nitrogen | % by weight | 0.60 |
| Sulfur | % by weight | 1.3922 |

Second Hydroconversion Step

In this example of the process according to the invention, the heavy effluent obtained from the intermediate separation section $B_1$ is all mixed with the heavy DAO obtained from the second fractionation section (e) in a heavy effluent/DAO volume ratio of 75/25. The composition of this feedstock is presented in Table 41.

TABLE 41

| Feedstock of step | | ($a_2$) |
|---|---|---|
| Density | | 0.9964 |
| Conradson carbon | % by weight | 11.6 |
| $C_7$ Asphaltenes | % by weight | 3.6 |

TABLE 41-continued

| Feedstock of step | | ($a_2$) |
|---|---|---|
| Nickel + Vanadium | ppm by weight | 59 |
| Nitrogen | % by weight | 0.55 |
| Sulfur | % by weight | 1.2671 |

In this example according to the invention, this mixture is all sent to a second hydroconversion section $A_2$ in the presence of hydrogen to undergo a second hydroconversion step ($a_2$). Said section $A_2$ is identical to the one described in Example 1.

The operating conditions applied in the hydroconversion step ($a_2$) are presented in Table 42 below.

TABLE 42

| Step | | ($a_2$) |
|---|---|---|
| Reactor HSV | $h^{-1}$ | 0.72 |
| Total P | MPa | 15.6 |
| Temperature | ° C. | 425 |
| Amount of hydrogen | $Nm^3/m^3$ | 250 |

These operating conditions make it possible to obtain a hydroconverted liquid effluent having a reduced content of Conradson carbon, of metals and of sulfur. The conversion per run of the 540° C.+ fraction achieved during this second hydroconversion step is 38.4% by weight.

First Fractionation Section

The hydroconverted liquid effluent resulting from the hydroconversion step ($a_2$) is sent to a fractionation step (c) performed in a fractionation section C composed of an atmospheric distillation column and a vacuum distillation column, after which a vacuum distillate fraction that boils at a temperature essentially between 350° C. and 500° C. (VD) and an unconverted vacuum residue fraction that boils at a temperature greater than or equal to 500° C. (VR) are recovered. The yields relative to the fresh feedstock and product qualities are given of this first fractionation section are indicated in Table 43 below.

TABLE 43

| | | VD | VR |
|---|---|---|---|
| Yield relative to the fresh feedstock | % by weight | 30.8 | 36.8 |
| Density | | 0.9558 | 1.061 |
| Conradson carbon | % by weight | 0.9 | 29 |
| $C_7$ Asphaltenes | % by weight | <0.05 | 10.2 |
| Nickel + Vanadium | ppm by weight | <4 | 65 |
| Nitrogen | % by weight | 0.47 | 0.82 |
| Sulfur | % by weight | 0.6541 | 1.2158 |
| Sediments | % by weight | <0.01 | 0.23 |

By comparing with Example 1, a higher degree of hydrotreatment with a lower density, and smaller contents of sulfur, nitrogen, metals, asphaltenes and Conradson carbon are observed. Furthermore, the VR contains a smaller amount of sediments and is thus more stable, notably by virtue of the presence of heavy aromatics of the DAO recycled upstream of the second hydroconversion step.

By comparing with Example 2, it is noted that the degree of hydrotreatment is lower, but that the VR contains a smaller amount of sediments. This cut is thus more stable, notably by virtue of the presence of heavy aromatics of the heavy DAO cut recycled upstream of the second hydroconversion step. In Example 2, the DAO is all recycled upstream of the first hydroconversion step and the heavy aromatics are further hydrogenated in comparison with the process according to the invention.

Deasphalting Step

The VR resulting from the first fractionation step is then advantageously sent to a deasphalting step (d) in a deasphalter, in which it is treated as described in Example 1 (same equipment and same conditions).

At the outlet of the deasphalter, a DAO and a residual asphalt are obtained, having the characteristics given in Table 44 below.

TABLE 44

| | | DAO | Residual asphalt |
|---|---|---|---|
| Yield | % by weight of the feedstock of the SDA | 71.6 | 28.4 |
| Density | | 0.9902 | 1.294 |
| Conradson carbon | % by weight | 6.1 | >30 |
| $C_7$ Asphaltenes | % by weight | <0.05 | >30 |
| Nickel + Vanadium | ppm by weight | <4 | 226 |
| Nitrogen | % by weight | 0.40 | 1.8 |
| Sulfur | % by weight | 0.7894 | 2.291 |

Second Fractionation Section

After the deasphalter D, the DAO cut produced is sent to a second fractionation step (e) performed in a fractionation section E composed of a series of flash drums, an atmospheric distillation column and a vacuum distillation column, after which a light DAO cut (DAO−) that boils at a temperature essentially below 580° C. and a heavy DAO cut (DAO+) that boils predominantly at a temperature greater than or equal to 580° C. are recovered. The characteristics of the light DAO cut and of the heavy DAO cut are given in Table 45 below.

TABLE 45

| | | DAO− | DAO+ |
|---|---|---|---|
| Distillation yield | % by weight | 38.8 | 61.2 |
| Density | | 0.9397 | 1.025 |
| Conradson carbon | % by weight | 0.20 | 9.8 |
| $C_7$ Asphaltenes | % by weight | <0.05 | not measured |
| Nickel + Vanadium | ppm by weight | <4 | <4 |
| Molybdenum | ppm by weight | <1 | not measured |
| Nitrogen | % by weight | 0.35 | 0.43 |
| Sulfur | % by weight | 0.5702 | 0.9283 |

The heavy DAO cut (DAO+) resulting from the fractionation step (e) is sent in its entirety to the second hydroconversion step, while the light DAO fraction (DAO−) is sent to an FCC catalytic cracking unit for additional conversion.

Step of Conversion in an FCC Unit

The light DAO cut (DAO−) resulting from the second fractionation section (e) performed in the fractionation section E is then sent to a fluid catalytic cracking unit, also referred to as an FCC unit. This conversion unit makes it possible to transform the DAO fraction, which is a 540° C.+ cut, into lighter fractions. This therefore makes it possible to increase the overall conversion of the starting feedstock. However, the liquid fraction resulting from the FCC unit still contains an unconverted 540° C.+ fraction, the yield of which is only 0.4% by weight relative to the feedstock of the FCC, as indicated in Table 46.

TABLE 46

| Unit | | FCC |
|---|---|---|
| Yield Gasoline (C5 – 220° C.) | % by weight | 47.2 |
| Yield Gas Oil (220 – 360° C.) | % by weight | 13.3 |
| Yield Vacuum Distillate (360 – 540° C.) | % by weight | 9.9 |
| Yield Vacuum Residue (540° C.+) | % by weight | 0.4 |

Overall Performance Qualities

According to the process of the invention illustrated in this example, including recycling of the DAO into the last hydroconversion step, the conversion per run of the 540° C.+ fraction of the fresh feedstock from the hydroconversion section is 64.6% by weight. The unconverted vacuum residue fraction contains 0.23% by weight of sediments, 65 ppm by weight of metals and a Conradson carbon content of 29% by weight. This cut is thus very difficult to upgrade. The deasphalting of the unconverted vacuum residue makes it possible to extract an upgradable fraction by separating the VR into a DAO fraction (which represents about 72% of the VR) and an asphalt fraction. The DAO fraction almost no longer contains any metals, or asphaltenes, and its Conradson carbon content is less than 6%. In this scheme according to the invention, the DAO cut is sent to a second fractionation section in order to produce a light DAO cut, which is sent to an FCC catalytic cracking unit for additional conversion, and a heavy DAO cut, which is all recycled into the inlet of the last hydroconversion step. By means of the recycling of the heavy DAO cut, the overall conversion of the 540° C.+ fraction of the fresh feedstock is 79.2% by weight in the hydrotreatment section. By means of the conversion of the light DAO in the FCC unit, and additional conversion of 4.0% by weight is obtained, leading to an overall conversion for the scheme according to the invention of 83.2% by weight for the 540° C.+ fraction of the fresh feedstock.

It is thus noted that, relative to Example 1, the conversion is much higher (+19 conversion points), while at the same time maintaining a stable VR which leaves the vacuum distillation column in the first fractionation step, stable since it contains a similar content of sediments (0.23% by weight instead of 0.20% by weight). Relative to Example 2, the conversion is not only higher (over 12 conversion points more), but the residual VR contains a smaller amount of sediments (0.23% by weight instead of 0.34% by weight) and thus remains more stable despite the more stringent conditions. As a result, in the scheme according to the invention, the fouling of the columns of the first fractionation section is greatly reduced relative to the scheme of Example 2 not in accordance with the invention, allowing a longer operation before stoppage for cleaning thereof. Compared with Example 3, the use of an FCC unit for the conversion of the light DAO cut makes it possible to produce more gasoline and less gas oil.

The invention claimed is:

1. A process for converting a heavy hydrocarbon feedstock containing a fraction of at least 50% with a boiling point of at least 300° C., and containing sulfur, Conradson carbon, metals, and nitrogen, comprising the following successive steps:

an initial step of hydroconversion ($a_1$) of at least one portion of said heavy hydrocarbon feedstock in the presence of hydrogen in an initial hydroconversion section ($A_1$), performed under conditions that make it possible to obtain a liquid effluent with a reduced content of sulfur, of Conradson carbon, of metals and of nitrogen;

(n−1) additional hydroconversion step(s) ($a_i$) in (n−1) additional hydroconversion section(s) ($A_i$), in the presence of hydrogen, of at least a portion or all of the liquid effluent resulting from the preceding hydroconversion step ($a_{i-1}$) or optionally of a heavy fraction resulting from an optional intermediate separation step ($b_j$) in an intermediate separation section ($B_j$) between two consecutive hydroconversion steps separating a portion or all of the liquid effluent resulting from the preceding hydroconversion step ($a_{i-1}$) in order to produce at least one heavy fraction that boils predominantly at a temperature greater than or equal to 350° C., the (n−1) additional hydroconversion step(s) ($a_i$) being performed so as to obtain a hydroconverted liquid effluent with a reduced content of sulfur, of Conradson carbon, of metals and of nitrogen, n being the total number of hydroconversion steps, with n greater than or equal to 2, i being an integer ranging from 2 to n and j being an integer ranging from 1 to (n−1), and the initial ($A_1$) and additional ($A_i$) hydroconversion section(s) each including at least one three-phase reactor containing at least one hydroconversion catalyst;

a first step of fractionating (c) in a first fractionation section (C) a portion or all of the hydroconverted liquid effluent resulting from the last additional hydroconversion step ($a_n$) producing at least one heavy cut that boils predominantly at a temperature greater than or equal to 350° C., said heavy cut containing a residual fraction that boils at a temperature greater than or equal to 540° C.;

a step of deasphalting (d) in a deasphalter (D) a portion or all of said heavy cut resulting from the fractionation step (c), with at least one hydrocarbon solvent, in order to obtain a deasphalted oil DAO and a residual asphalt;

a second step of fractionating (e) in a second fractionation section (E) a portion or all of the DAO resulting from the deasphalting step (d) into at least one heavy DAO fraction and one light DAO fraction, in which the second fractionation section (E) comprises one or more flash drums arranged in series, and/or one or more steam- and/or hydrogen-stripping columns, and/or an atmospheric distillation column, and/or a vacuum distillation column;

a step of recycling (f) at least one portion of the DAO resulting from step (d) and/or at least one portion of the heavy fraction of the DAO resulting from step (e) into an additional hydroconversion step ($a_i$) and/or into an intermediate separation step ($b_j$).

2. The process as claimed in claim 1, in which said heavy hydrocarbon feedstock has a sulfur content of at least 0.1% by weight, a Conradson carbon content of at least 0.5% by weight, a $C_7$ asphaltenes content of at least 1% by weight, and a metals content of at least 20 ppm by weight.

3. The process as claimed in claim 1, in which said heavy hydrocarbon feedstock is a crude oil or consists of atmospheric residues and/or vacuum residues resulting from the atmospheric and/or vacuum distillation of crude oil.

4. The process as claimed in claim 1, in which said three-phase reactor containing at least one hydroconversion catalyst is a three-phase reactor with ebullated-bed operation, with an upflow of liquid and of gas.

5. The process as claimed in claim 1, in which said three-phase reactor containing at least one hydroconversion catalyst is a three-phase reactor with hybrid-bed operation, said hybrid bed including at least one catalyst maintained in said three-phase reactor and at least one catalyst entrained out of said three-phase reactor.

6. The process as claimed in claim 1, in which the initial hydroconversion step ($a_1$) is performed under an absolute pressure of between 2 and 38 MPa, at a temperature of between 300° C. and 550° C., at an hourly space velocity HSV relative to the volume of each three-phase reactor of between 0.05 $h^{-1}$ and 10 $h^{-1}$ and under an amount of hydrogen mixed with the heavy hydrocarbon feedstock of between 50 and 5000 normal cubic meters ($Nm^3$) per cubic meter ($m^3$) of heavy hydrocarbon feedstock.

7. The process as claimed in claim 1, in which the additional hydroconversion step(s) ($a_n$) are performed at a temperature of between 300° C. and 550° C., and above the temperature used in the initial hydroconversion step ($a_1$), under an amount of hydrogen mixed with the heavy hydrocarbon feedstock of between 50 and 5000 normal cubic meters ($Nm^3$) per cubic meter ($m^3$) of heavy hydrocarbon feedstock, and less than the amount of hydrogen used in the initial hydroconversion step ($a_1$), under an absolute pressure of between 2 and 38 MPa, and at an hourly space velocity HSV relative to the volume of each three-phase reactor of between 0.05 $h^{-1}$ and 10 $h^{-1}$.

8. The process as claimed in claim 1, in which the intermediate separation section ($B_j$) comprises one or more flash drums arranged in series, and/or one or more steam- and/or hydrogen-stripping columns, and/or an atmospheric distillation column, and/or a vacuum distillation column.

9. The process as claimed in claim 1, in which the first fractionation section (C) comprises one or more flash drums arranged in series, and/or one or more steam- and/or hydrogen-stripping columns, and/or an atmospheric distillation column, and/or a vacuum distillation column.

10. The process as claimed in claim 1, in which the second fractionation section (E) consists of a set of several flash drums in series and a vacuum distillation column.

11. The process as claimed in claim 1, in which the deasphalting step (d) is performed in an extraction column at a temperature of between 60° C. and 250° C. with at least one hydrocarbon solvent containing from 3 to 7 carbon atoms, and a (volume/volume) solvent/feedstock ratio of between 3/1 and 16/1.

12. The process as claimed in claim 1, in which a portion of the heavy hydrocarbon feedstock is sent to at least one additional hydroconversion section ($A_i$) and/or to at least one intermediate separation section ($B_j$) and/or to the first fractionation section (C) and/or to the deasphalter (D).

13. The process as claimed in claim 1, in which a hydrocarbon feedstock external to the process is sent to the initial hydroconversion section ($A_1$) and/or to at least one additional hydroconversion section ($A_i$) and/or to at least one intermediate separation section ($B_j$) and/or to the first fractionation section (C) and/or to the deasphalter (D).

14. The process as claimed in claim 1, also comprising at least one recycling step below:

the recycling ($r_1$) of a portion or all of the light fraction of the DAO resulting from step (e) into the initial hydroconversion section ($A_1$) and/or into at least one additional hydroconversion section ($A_i$) and/or into at least one intermediate separation section ($B_j$) and/or into the first fractionation section (C);

the recycling ($r_2$) of a portion of the heavy fraction of the DAO resulting from step (f) into the first fractionation section (C);

the recycling ($r_3$) of a portion of the DAO resulting from step (d) into the first fractionation section (C);

the recycling ($r_4$) of a portion or all of the residual asphalt resulting from step (d) into the initial hydroconversion section ($A_1$) and/or into at least one additional hydroconversion section ($A_i$);

the recycling ($r_5$) of a portion of the hydroconverted liquid effluent from a given additional hydroconversion section ($A_i$):

into the initial hydroconversion section ($A_1$), and/or into another additional hydroconversion section ($A_i$) positioned upstream of said given section ($A_i$), and/or into an intermediate separation section ($B_j$) positioned upstream of said given section);

the recycling ($r_6$) of a portion of the heavy fraction and/or of a portion or all of one or more intermediate fractions resulting from a given intermediate section ($B_j$):

into the initial hydroconversion section ($A_1$), and/or into an additional hydroconversion section ($A_i$) positioned upstream of said given intermediate section ($B_j$), and/or into another intermediate separation section ($B_j$) positioned upstream of said given section ($B_j$);

the recycling ($r_7$) of a portion of the heavy fraction and/or of a portion or all of one or more intermediate fractions resulting from the first fractionation section (C):

into the initial hydroconversion section ($A_1$), and/or into an additional hydroconversion section ($A_i$), and/or into an intermediate separation section ($B_j$).

15. The conversion process as claimed in claim 1, in which n is equal to 2, and comprising the following successive steps:

an initial step of hydroconversion ($a_1$) of at least one portion of said heavy hydrocarbon feedstock in the presence of hydrogen in an initial hydroconversion section ($A_1$), performed under conditions that make it possible to obtain a liquid effluent with a reduced content of sulfur, of Conradson carbon, of metals and of nitrogen;

an additional hydroconversion step ($a_2$) in an additional hydroconversion section ($A_2$), in the presence of hydrogen, of at least a portion or all of the liquid effluent resulting from the initial hydroconversion step ($a_1$) or optionally of a heavy fraction resulting from an optional intermediate separation step ($b_1$) in an intermediate separation section ($B_1$) between the initial ($a_1$) and additional ($a_2$) hydroconversion steps separating a portion or all of the liquid effluent resulting from the initial hydroconversion step ($a_1$) into at least one light fraction that boils predominantly at a temperature below 350° C. and at least one heavy fraction that boils predominantly at a temperature greater than or equal to 350° C., the additional hydroconversion step ($a_2$) being performed so as to obtain a hydroconverted liquid effluent with a reduced content of sulfur, of Conradson carbon, of metals, and of nitrogen, the initial ($A_1$) and additional ($A_2$) hydroconversion sections each including at least one three-phase reactor containing at least one hydroconversion catalyst;

a first step of fractionating (c) in a first fractionation section (C) a portion or all of the hydroconverted liquid effluent resulting from the additional hydroconversion step ($a_2$) producing at least one heavy cut that boils predominantly at a temperature greater than or equal to 350° C., said heavy cut containing a residual fraction that boils at a at a temperature greater than or equal to 540° C.;

a step of deasphalting (d) in a deasphalter (D) a portion or all of said heavy cut resulting from the fractionation step (c), with at least one hydrocarbon solvent, in order to obtain a deasphalted oil DAO and a residual asphalt;

a second step of fractionating (e) in a second fractionation section (E) a portion or all of the DAO resulting from the deasphalting step (d) into at least one heavy DAO fraction and one light DAO fraction, in which the second fractionation section (E) comprises one or more flash drums arranged in series, and/or one or more steam- and/or hydrogen-stripping columns, and/or an atmospheric distillation column, and/or a vacuum distillation column;

a step of recycling (f) at least one portion of the DAO resulting from step (d) and/or at least one portion of the heavy fraction of the DAO resulting from step (e) into an additional hydroconversion step ($a_2$) and/or into an intermediate separation step ($b_1$).

16. The process as claimed in claim 1, including the recycling (f) of all of the DAO resulting from step (d) or of all of the heavy fraction resulting from the second fractionation step (e) into the last additional hydroconversion step ($a_i$).

17. The process as claimed in claim 1, including the recycling (f) of all of the DAO resulting from step (d) or of all of the heavy fraction resulting from the second fractionation step (e) to an intermediate separation step ($b_j$).

18. The process as claimed in claim 1, not including an intermediate separation step ($b_j$) and including the recycling (f) of all of the DAO resulting from step (d) to the last additional hydroconversion step ($a_i$).

19. The process as claimed in claim 1, in which said hydroconversion catalyst of said at least one three-phase reactor of the initial hydroconversion section ($A_1$) and of the additional hydroconversion section(s) ($A_i$) contains at least one metal from the non-noble group VIII selected from the group consisting of nickel and cobalt and at least one metal from group VIB selected from the group consisting of molybdenum and tungsten.

20. The process as claimed in claim 15, in which the second fractionation section (E) consists of a set of several flash drums in series and a vacuum distillation column.

* * * * *